US005427178A

United States Patent [19]

Bland

[11] Patent Number: 5,427,178

[45] Date of Patent: Jun. 27, 1995

[54] TUBING ROTATOR AND HANGER

[75] Inventor: Linden H. Bland, Edmonton, Canada

[73] Assignee: Rodec Tool Company Inc., Edmonton, Canada

[21] Appl. No.: 198,114

[22] Filed: Feb. 17, 1994

[51] Int. Cl.[6] ..... E21B 43/00

[52] U.S. Cl. ..... 166/78

[58] Field of Search ..... 166/78, 85, 75.1

[56] References Cited

U.S. PATENT DOCUMENTS

| | | | |
|---|---|---|---|
| 2,178,700 | 11/1939 | Penick et al. | 166/78 |
| 2,294,061 | 8/1942 | Williamson . | |
| 2,471,198 | 5/1949 | Cormany | 166/78 |
| 2,595,434 | 5/1952 | Williams . | |
| 2,599,039 | 6/1952 | Baker . | |
| 2,630,181 | 3/1953 | Solum . | |
| 2,693,238 | 11/1954 | Baker . | |
| 4,716,961 | 1/1988 | Makins, Jr. et al. | 166/68.5 |
| 4,844,171 | 7/1989 | Russell, Jr. | 166/78 X |
| 4,993,276 | 2/1991 | Edwards | 166/78 X |
| 5,139,090 | 8/1992 | Land . | |

OTHER PUBLICATIONS

National Oilwell Canada Ltd., "Variperm Packers", catalogue, marked received Dec. 13, 1993.

Rotating Production Systems Inc., "Rotating Tubing Hangers", catalogue, undated, pp. 6–8.

Stream-Flo Industries Ltd., Wellhead Catalogue, undated, pp. 1–2, 14–20.

Graham, Marc and Brown, Charlie "Tubing Rotator System Increases Pumping Unit Tubular Life," *Petroleum Engineer International,* Oct. 1993, pp. 46–47.

Graham, Marc and Brown, Charlie "Tubing rotator reduces tubing wear in rod pumped wells", *Oil & Gas Journal,* Apr. 4, 1994, pp. 52–54.

Bock Specialties Inc., catalogue, undated, pp. 1–16.

*Primary Examiner*—William P. Neuder

*Attorney, Agent, or Firm*—Rodman & Rodman

[57] ABSTRACT

A tubing rotator and hanger that attaches to a wellhead for suspending and rotating a tubing string contained in a wellbore. The tubing hanger comprises a support flange which mounts on the wellhead flange. The tubing rotator comprises a tubular outer member which engages the support flange, a tubular inner mandrel which is connected to the tubing string which is rotationally supported within the outer member, apparatus for rotating the inner mandrel which engage the inner mandrel at its upper end, and a housing mounted around the upper end of the inner mandrel for supporting the portion of the wellhead located above the tubing rotator. The rotating apparatus may be disengaged from this inner mandrel and the housing is removable so that a blowout preventer may be placed on top of the support flange and over the outer member and the inner mandrel and mounted on the wellhead without first moving the tubing string, and so that the outer member, the inner mandrel and the tubing string may be pulled through the blowout preventer to service the well. An adaptor is provided so that the rotating apparatus may be driven automatically by a rotating polished rod. The adaptor comprises a sleeve that fixedly mounts on the rotating rod, a shaft which engages the sleeve in order to be rotated as the sleeve rotates, and an adaptor housing for supporting the first shaft mounted about the sleeve so that the sleeve may rotate within the adaptor housing. The first shaft is connected to the rotating apparatus by a flexible second shaft, and the rotating apparatus includes a gearbox which creates a mechanical advantage so that rotation of the rotating rod rotates the inner mandrel and the tubing string.

75 Claims, 10 Drawing Sheets

TUBING ROTATOR AND HANGER

TECHNICAL FIELD

The present invention relates to an apparatus for attachment to a wellhead for suspending and rotating a tubing string contained within a wellbore and an adaptor for connection to a rotating rod included in the wellhead for driving the apparatus, or a mechanism having similar driving means, by the rotation of the rotating rod.

BACKGROUND ART

Wellbores may be drilled in a number of different configurations. Conventionally, wellbores have been drilled in a vertical orientation. However, during drilling, the drill bit may deflect or deviate from vertical for many reasons including the orientation of the formation which the drill bit encounters, the weight on the drill bit, and the penetration rate of the drill bit. Other wellbores have been intentionally drilled in a slant configuration with a constant slant angle to the surface or in a manner such that the wellbore intentionally deviates or changes direction, typically from a vertical to a horizontal orientation. As a result, most wellbores will contain intentional or non-intentional deviations or direction changes within the wellbore.

Once drilled and cased, a tubing string is run into the wellbore, and a reciprocating rod or a rotating rod is run through the tubing string for production of the well. The qualities of the produced fluids and solids pumped from the wellbore, including viscosity, weight and abrasivity, may vary depending upon the amount of water, in a free or emulsified state, and the amount of sand and other fine solids from the formation that are produced along with the produced hydrocarbons. Lighter less viscous hydrocarbon production often precipitates out paraffin or wax, which collects on the outer surface of the rod and the inner surface of the tubing string.

During production, the configuration of the wellbore and the qualities of the produced fluids, being water and produced hydrocarbons, and solids can impact greatly on the wear of the outer surface of the rod or rod couplings, the inner surface of the tubing string and the inner surface of the downhole pump barrel. It has been found that the amount of wear typically increases with an increase in the slant angle of the wellbore or an increase in the severity of the dogleg which is the rate at which the direction or angle of the wellbore changes. The amount of wear also typically increases with an increase in the amount of water or sand produced along with the hydrocarbons. Further, wax or paraffin collection may gradually restrict the flow of the produced fluids and solids in the tubing string and increase the downhole pump pressure.

The problems of wear and restricted fluid flow are potentially very costly as they may result in equipment failures and lost production time. For instance, the rod or rod couplings may wear to the point of separation or the action of the rod may wear a hole in the tubing string. This may result in the leakage of produced fluids and solids back down the wellbore. As a result, various attempts have been made to protect the rod from wear such as hard surfacing the rod couplings, coating them with teflon and other materials, or providing roller guides or centralizers for the rod within the tubing string. However, these approaches provide limited protection against wear on the tubing string or the pump barrel and the buildup of paraffin or wax.

Wear on the tubing string and the pump barrel arid the reduction of any paraffin or wax buildup has been addressed by tubing rotators. Tubing rotators rotate the tubing string within the wellbore, which distributes the wear over the entire internal surface of the tubing string, and thus prolongs its life. As welt, the constant movement of the inner surface of the tubing string relative to the rod inhibits or reduces the buildup of paraffin or wax.

In conventional wells, at least a portion of the wellbore is typically completed by cementing a casing string into the wellbore. After the casing string is installed, a casing bowl is typically welded or screwed to the top of the casing string at the surface. To suspend the tubing string in the wellbore, when a tubing rotator is not in use, a dognut conforming to the inner surface of the casing bowl is typically hung within the casing bowl. The other parts of the wellhead are then mounted to the top of the casing bowl. In order to service the well, the rod and the tubing string must be removed. However, any movement or disturbance of the tubing string during servicing may lead to a blowout. To avoid this risk in a conventional well without a tubing rotator, the portion of the wellhead above the casing bowl is removed and a blowout preventer is mounted to the casing bowl. The dognut with the attached tubing string is then removed through the blowout preventer.

Known tubing rotators, such as those described in U.S. Pat. No. 2,599,039 issued Jun. 3, 1952 to Baker, U.S. Pat. No. 2,471,198 issued May 24, 1949 to Cormany, U.S. Pat. No. 2,595,434 issued May 6, 1952 to Williams, U.S. Pat. No. 2,630,181 issued Mar. 3, 1953 to Solum and U.S. Pat. No. 5,139,090 issued Aug. 18, 1992 to Land, suspend the tubing string from, and are mounted to, the upper portion or flange of the casing bowl in a manner that a blowout preventer cannot be installed or mounted to the casing bowl without first removing the portion of the tubing rotator supported by the casing bowl. Removal of the necessary portion of the tubing rotator requires movement or disturbance of the tubing string. This may lead to a blowout. In effect, known tubing rotators are typically supported from the same area or surface of the casing bowl required for mounting of the blowout preventer. Thus, the tubing rotator interferes with the installation of the blowout preventer and the blowout preventer cannot be installed during servicing without first moving the tubing string.

Further, known tubing rotators, such as that shown in Williams, may include a dognut or dognut-shaped part, compatible with the inner surface of the casing bowl, for suspending the tubing string within the casing bowl. This design requires the lower portion of the tubing rotator to conform to the shape of the inner surface of the casing bowl, which may be limiting given that casing bowls often vary in shape and size from wellhead to wellhead. The result is that a specific tubing rotator may not necessarily be usable with every wellhead as the size and shape of the lower portion of the tubing rotator may not be compatible with every casing bowl to which it is to be mounted.

Further, the structure of many known tubing rotators, such as Cormany and Williams, requires the use of an exposed swivel connection in the wellhead above the tubing rotator which may weaken the overall structure of the wellhead and add significant height to it.

As well, in order to provide even distribution of the wear on the rod and the tubing string, the tubing string is preferably turned automatically on a continuous basis. Means for operating the tubing rotators to provide for automatic rotation of the tubing string are known. For example, Solum describes an apparatus for continuously rotating the tubing string which is operated by hydraulic pressure. However, the means for operating the tubing rotator are preferably driven by, and combined with, the producing action of the wellhead, as shown in Cormany, Williams, Land and U.S. Pat. No. 2,693,238 issued Nov. 2, 1954 to Baker. These patents all provide for a tubing rotator which is connected to a wellhead having a reciprocating rod attached to a walking beam. The tubing rotator is continuously driven by the reciprocating action or movement of the walking beam. However, these operating means are not always useful given that many wellheads today use a rotating rod for production of the well rather than a reciprocating rod and walking beam structure.

Finally, damage may result to the joints or connections of the tubing string, the tubing rotator and the means for operating the tubing rotator if too much torque is generated by the operating means and the tubing rotator, for example, when the tubing string becomes stuck in the wellbore. Thus, it is preferable that a torque limiting device be incorporated in series with the operating means and the tubing rotator. In Williams, frictional contact between an inner mandrel and the rotating means provides for some limiting of the generated torque. However, the torque at which slippage occurs is not adjustable.

Therefore, there is a need in the industry for a relatively compact apparatus, for attachment to a wellhead, for both suspending and rotating a tubing string contained within a wellbore that can be partially dismantled during servicing for removal from the wellhead in a manner to allow for the mounting of a blowout preventer on the wellhead without first moving the tubing string within the wellbore so that once the blowout preventer is mounted on the wellhead, the remaining parts of the tubing rotator and the tubing string may be removed through the blowout preventer. Further, there is a need for the apparatus, and similar rotating mechanisms, to include means for operatively connecting to a rotating rod such that the rotation of the rotating rod operates or engages the apparatus. Finally, there is a need for adjustable means for limiting the torque applied to the apparatus and the means for connecting to the rotating rod.

DISCLOSURE OF INVENTION

The present invention relates to a relatively compact apparatus for attachment to a wellhead, for suspending and rotating a tubing string contained within a wellbore that is not dependent upon, or needs to be compatible with, the interior surfaces of any particular casing bowl and which may be partially dismantled during servicing for removal from the wellhead so that a blowout preventer may be placed over the remainder of the apparatus for mounting on the wellhead without first moving the tubing string suspended by the apparatus. The remainder of the apparatus, along with the tubing string, is then capable of removal through the blowout preventer. Further, the present invention relates to the apparatus, or similar mechanisms, including means for operatively connecting to a rotating rod included in the wellhead such that the rotation of the rotating rod operates or engages the apparatus.

In a first aspect of the invention, the invention is comprised of an apparatus for attachment to a wellhead for suspending and rotating a tubing string contained within a wellbore, the wellhead having a wellhead flange. The apparatus comprises: a support flange for mounting on the wellhead flange; a tubular outer member having an upper end for detachably engaging the support flange such that the outer member is suspended therefrom and a lower end for extending into the wellbore; a tubular inner mandrel rotatably supported within the outer member such that at least the downward longitudinal movement of the inner mandrel relative to the outer member is inhibited, the inner mandrel having an upper end and a lower end extending through the lower end of the outer member for connecting to the tubing string; means, releasably engageable with the upper end of the inner mandrel, for rotating the inner mandrel and the tubing string while the outer member remains stationary; and a tubular housing removably mounted around the upper end of the inner mandrel for supporting the portion of the wellhead above the apparatus; wherein the rotating means are releasable from the inner mandrel and the housing is removable so that a blowout preventer may be placed on top of the support flange and over the outer member and the inner mandrel and mounted on the wellhead without first moving the tubing string and so that the outer member, the inner mandrel and the tubing string may be pulled through the blowout preventer in order to service the well.

In the first aspect, the wellhead flange preferably includes at least one adjustable holddown screw for engagement with the outer member. Further, the outer surface of the lower end of the outer member preferably includes a compatible engagement surface for receiving the holddown screw such that when the holddown screw is adjusted to be received within the engagement surface, longitudinal movement of the outer member relative to the wellhead flange is inhibited. The apparatus may further comprise means for securing the inner mandrel to the outer member such that upward longitudinal movement of the inner mandrel relative to the outer member is inhibited. The securing means are preferably comprised of a retaining ring secured to the inner mandrel adjacent to the lower end of the outer member. The retaining ring is preferably removable to permit upward longitudinal movement of the inner mandrel relative to the outer member.

In addition, the wellhead flange preferably defines more than one aperture forming a first bolt ring for receiving fasteners therein. The wellhead may further comprise a tubular adaptor flange mountable on the upper surface of the housing such that when the apparatus is attached to the wellhead, the housing and the support flange are located between the adaptor flange and the wellhead flange. The adaptor flange may also define more than one aperture forming a second bolt ring compatible with the first bolt ring, the housing, and the support flange such that fasteners can be extended through the apertures in the adaptor flange and the wellhead flange in order to secure the housing and the support flange between the adaptor flange and the wellhead flange. The inner diameters of the first bolt ring and the second bolt ring define the diameter of a cylindrical space. Preferably, the housing, the inner mandrel and the outer member are contained completely within the diameter of the cylindrical space. As well, the support flange is preferably contained completely within the diameter of the cylindrical space.

Further, the inner mandrel may be rotatably supported within the outer member by a thrust bearing located between the inner mandrel and the outer member such that the thrust bearing is seated on the outer member and the inner mandrel is rotatably supported upon the thrust bearing. Preferably the wellbore includes a casing string for containing the tubing string. Further, the wellhead flange is preferably located at the upper end of the casing string.

Preferably, the inner mandrel includes a crown gear and the rotating means are comprised of a rotatable pinion contained within the housing and releasably engaged with the crown gear and means for driving the pinion such that rotation of the pinion rotates the inner mandrel within the outer member. The inner mandrel preferably extends through the upper end of the outer member for connecting to the crown gear. The crown gear is preferably integral with the inner mandrel. Further, the driving means may be comprised of a pinion shaft extending into the housing for connection to the pinion and means for turning the pinion shaft. The turning means may be comprised of means operatively and releasably connected to the pinion shaft for creating a mechanical advantage to facilitate the generation of sufficient torque to turn the pinion shaft in order to rotate the inner mandrel and the tubing string. The mechanical advantage creating means are preferably comprised of at least one set of gears. Preferably, the turning means are further comprised of means, operatively connected to the mechanical advantage creating means, for limiting the torque generated by the mechanical advantage creating means in order to inhibit the generation of torque sufficient to cause damage to the apparatus or the tubing string.

The turning means may be manually operable. As well, the wellhead may include a reciprocating rod and the turning means may be operatively connected to the reciprocating rod such that reciprocation of the reciprocating rod turns the pinion shaft in order to rotate the inner mandrel. However, preferably, the wellhead includes a rotating rod and the turning means are operatively connected to the rotating rod such that rotation of the rotating rod turns the pinion shaft in order to rotate the inner mandrel.

Where the wellhead includes a rotating rod, the apparatus may be further comprised of an adaptor for operatively connecting the rotating rod to the mechanical advantage creating means such that rotation of the rotating rod turns the pinion shaft in order to rotate the inner mandrel. The adaptor is preferably comprised of: a tubular sleeve fixedly mountable on the rotating rod such that the rod is contained within the sleeve and rotation of the rod rotates the sleeve; a first shaft having a connector end and a drive end, the drive end being releasably engaged with the sleeve such that the rotation of the sleeve rotates the first shaft; an adaptor housing for supporting the drive end of the first shaft mounted about the sleeve such that the sleeve is rotatable within the adaptor housing while the adaptor housing remains stationary; and means for operatively connecting the first shaft to the rotating means so that rotation of the rotating rod rotates the inner mandrel and the tubing string.

The connecting means are preferably comprised of a flexible second shaft having a first end operatively connected to the connector end of the first shaft such that rotation of the first shaft rotates the second shaft and a second end operatively connectable to the mechanical advantage creating means so that the torque generated by rotation of the second shaft is translated to sufficient torque to turn the pinion shaft in order to rotate the inner mandrel.

The mechanical advantage creating means are preferably comprised of more than one set of gears in series such that the torque generated by the second shaft is stepped up in stages to a level sufficient to turn the pinion shaft in order to rotate the inner mandrel. Preferably, the mechanical advantage creating means are comprised of three worm and worm gear sets in series.

The sleeve may include a crown gear which is releasably engaged with a pinion on the drive end of the first shaft such that rotation of the sleeve rotates the first shaft. A releasable clamping ring may be secured about the sleeve for fixedly mounting the sleeve on the rotating rod. Further, at least one support bearing may be located between the sleeve and the adaptor housing such that the sleeve is rotatable within the stationary adaptor housing. As well, the first shaft may be rotatably supported within the adaptor housing by at least one support bearing.

In a second aspect of the invention, the invention comprises an adaptor. The adaptor is to be used in combination with an apparatus, connected to a wellhead including a rotating rod, for suspending and rotating a tubing string contained within a wellbore. The apparatus includes means for rotating the tubing string suspended by the apparatus. The adaptor operatively connects the rotating rod to the rotating means such that rotation of the rotating rod operates the rotating means in order to rotate the tubing string within the wellbore. The adaptor comprises: a tubular sleeve fixedly mountable on the rotating rod such that the rod is contained within the sleeve and rotation of the rod rotates the sleeve; a first shaft having a connector end and a drive end, the drive end being releasably engaged with the sleeve such that rotation of the sleeve rotates the first shaft; an adaptor housing for supporting the drive end of the first shaft mounted about the sleeve such that the sleeve is rotatable within the adaptor housing while the adaptor housing remains stationary; and means for operatively connecting the first shaft to the rotating means so that rotation of the rotating rod rotates the tubing string.

In a third aspect of the invention, the invention comprises an adaptor, for connection to a wellhead having a rotating rod, for use with an apparatus having rotating means for operating the apparatus. The adaptor comprises: a tubular sleeve fixedly mountable on the rotating rod such that the rod is contained within the sleeve and rotation of the rod rotates the sleeve; a first shaft having a connector end and a drive end, the drive end being releasably engaged with the sleeve such that rotation of the sleeve rotates the first shaft; an adaptor housing for supporting the drive end of the first shaft mounted about the sleeve such that the sleeve is rotatable within the adaptor housing while the adaptor housing remains stationary; and means for connecting the first shaft to the rotating means in order to operate the apparatus.

In the second and third aspects of the invention, the connecting means may be comprised of a flexible second shaft having a first end operatively connected to the connector end of the first shaft such that rotation of the first shaft rotates the second shaft and a second end operatively connectable to the rotating means such that rotation of the second shaft operates the apparatus.

In the second and third aspects of the invention, the rotating means may be comprised of means for creating a mechanical advantage to facilitate the generation of sufficient torque by the adaptor to rotate the rotating means in order to operate the apparatus. Further, the connecting means may be comprised of a flexible second shaft having a first end operatively connected to the connector end of the first shaft such that rotation of the first shaft rotates the second shaft and a second end operatively connectable to the mechanical advantage creating means so that the torque generated by rotation of the second shaft is translated to sufficient torque to rotate the rotating means. Preferably, the mechanical advantage creating means are comprised of at least one set of gears. Further, the mechanical advantage creating means are preferably operatively connected to means for limiting the torque generated by the mechanical advantage creating means in order to inhibit the generation of torque sufficient to cause damage to the adaptor or the apparatus.

Further, in the second and third aspects of the invention, the mechanical advantage creating means are preferably comprised of more than one set of gears in series such that the torque generated by the second shaft is stepped up in stages to a level sufficient to rotate the rotating means of the apparatus. The mechanical advantage creating means may be comprised of three worm and worm gear sets in series.

The sleeve preferably includes a crown gear which is releasably engaged with a pinion on the drive end of the first shaft such that rotation of the sleeve rotates the first shaft. Further, a releasable clamping ring may be secured about the sleeve for fixedly mounting the sleeve on the rotating rod. As well, at least one support bearing may be located between the sleeve and the adaptor housing such that the sleeve is rotatable within the stationary adaptor housing. The first shaft may also be rotatably supported within the adaptor housing by at least one support bearing.

BRIEF DESCRIPTION OF DRAWINGS

Embodiments of the invention will now be described with reference to the accompanying drawings, in which.

BEST MODE OF CARRYING OUT INVENTION

Figure 1:
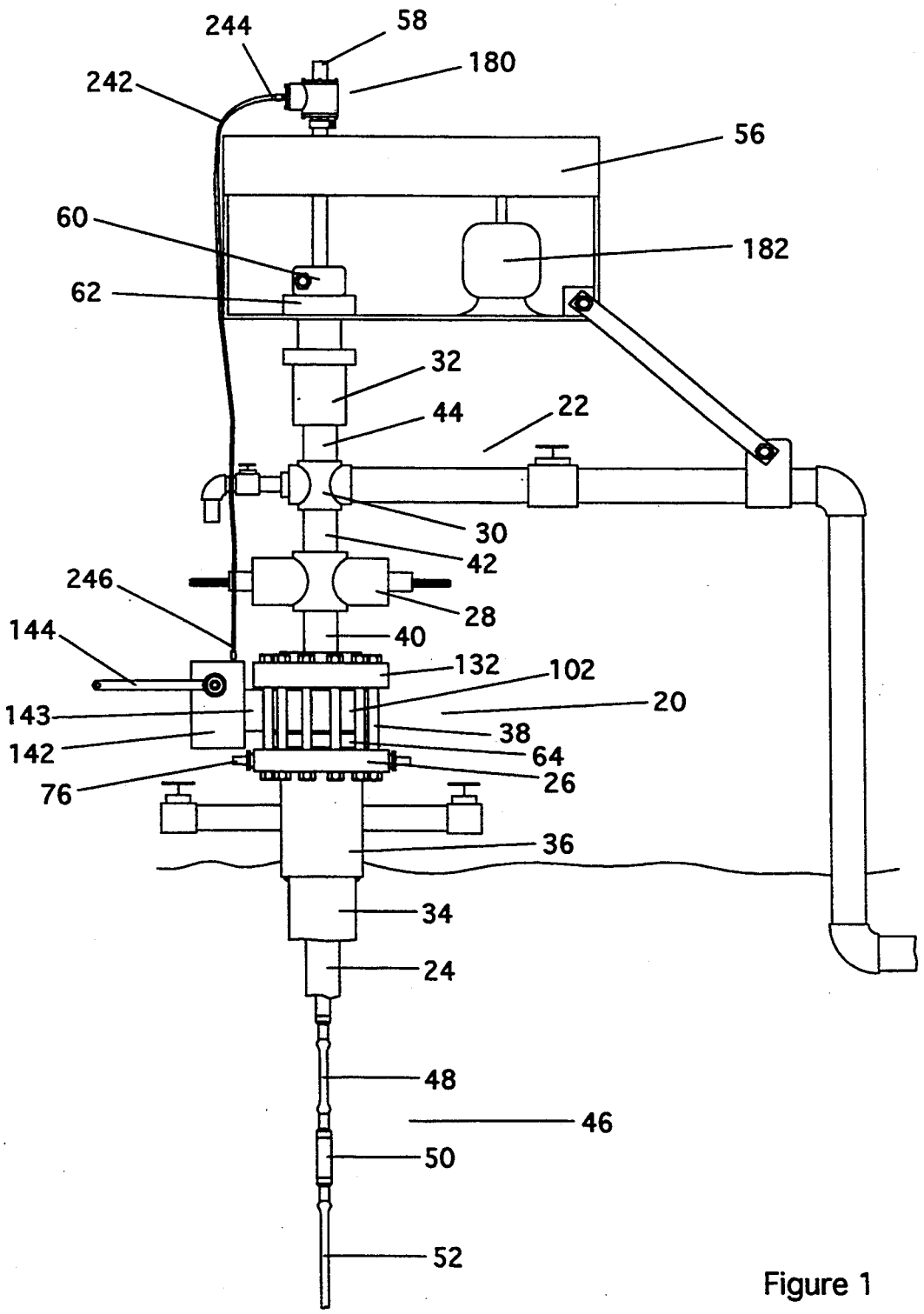
FIG. 1 is a side view of a wellhead, having a rotating rod, in which the apparatus and the adaptor are mounted for operation.
Figure 2:
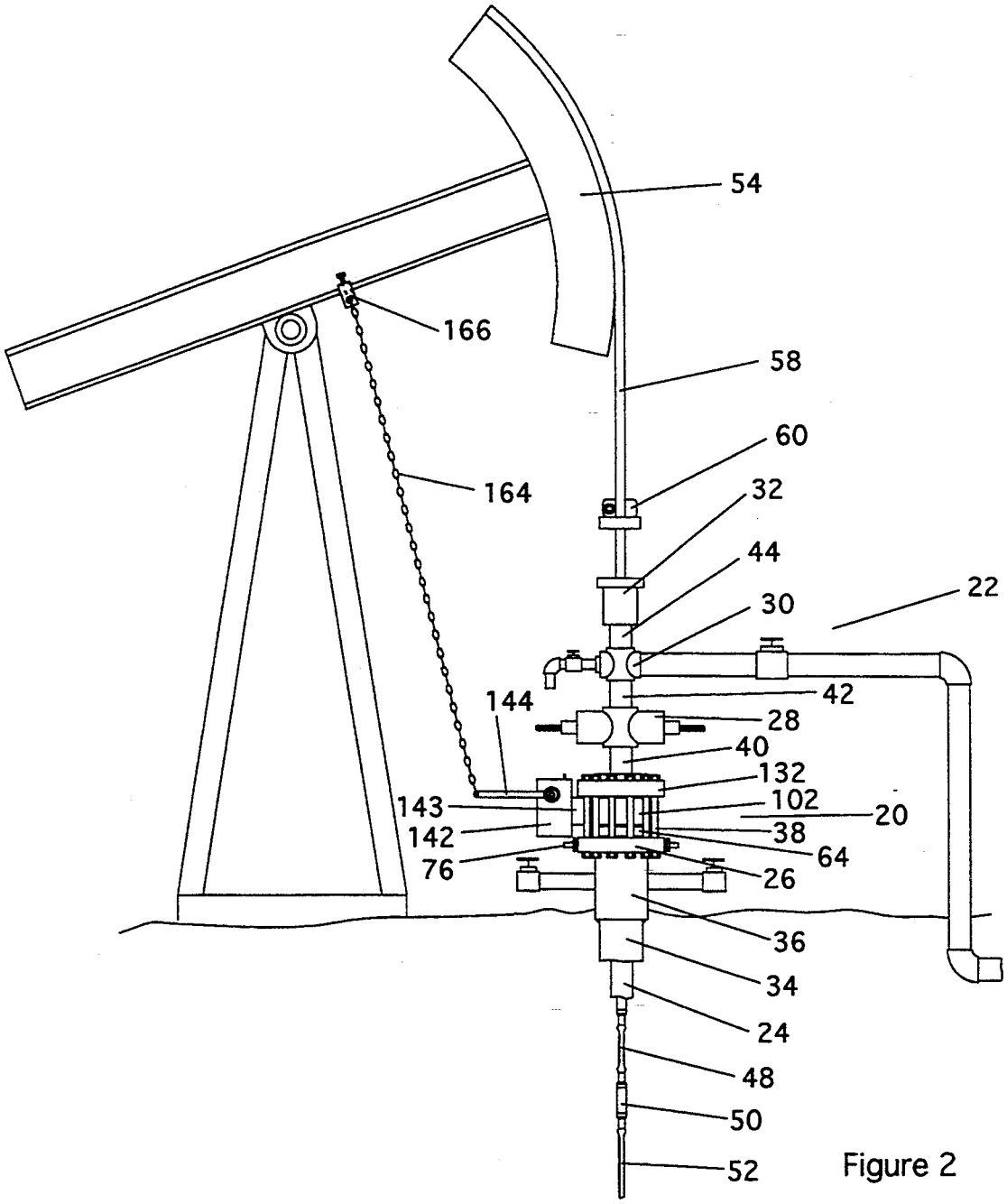
FIG. 2 is a side view of a wellhead, having a reciprocating rod and walking beam, in which the apparatus is mounted for operation.

Referring to FIGS. 1 and 2, the within invention is an apparatus (20), for attachment to a wellhead (22), for suspending and rotating a tubing string (24) contained within a wellbore. A typical wellhead (22) is comprised of a wellhead flange (26), an adaptor flange (132), a rod blowout preventer (28), a flow tee (30) and a rod stuffing box (32). The apparatus (20) and the other portions of the wellhead (22) are mounted above the wellhead flange (26).

The apparatus (20) is mounted to the wellhead flange (26) by fasteners (38), being preferably screws or bolts. The lower end of the rod blowout preventer (28) is connected to the upper end of the apparatus (20) by a first nipple (40) and an adaptor flange (132). The lower end of the flow tee (30) is then connected to the upper end of the rod blowout preventer (28) by a second nipple (42). Finally, the lower end of the rod stuffing box (32) is connected to the upper end of the flow tee (30) by a third nipple (44). A rod (46) is run through the wellhead (22) into the wellbore. The rod (46) is comprised of a number of pieces such as a pony rod (48), rod couplings (50) and a sucker rod (52). A pump plunger or a pump rotor (not shown) are attached to the lower end of the rod (46), which are located in a downhole pump barrel or stator respectively (not shown). A downhole plunger and barrel are used when the well is produced by a reciprocating rod (46), reciprocated by a pumpjack or walking beam at the surface as shown in FIG. 2. A downhole rotor and stator are used when the well is produced by a rotating rod (46), driven by a rotary pump drive (56) at the surface as shown in FIG. 1. In either case, the upper end of the rod (46) includes a polished rod (58) that extends through the entire wellhead (22). The polished rod (58) provides a smooth sealable surface between the reciprocating or rotating rod (46) and the rod stuffing box (32) or the rod blowout preventer (28) when it is closed.

The upper end of the polished rod (58) is held by a rod clamp (60) such that the rod (46) is suspended in the wellhead (22) and the wellbore. The rod clamp (60) is supported either by the walking beam, as shown in FIG. 2, or from a thrust bearing plate (62) forming part of the rotary pump drive (56), as shown in FIG. 1.

Figure 3:
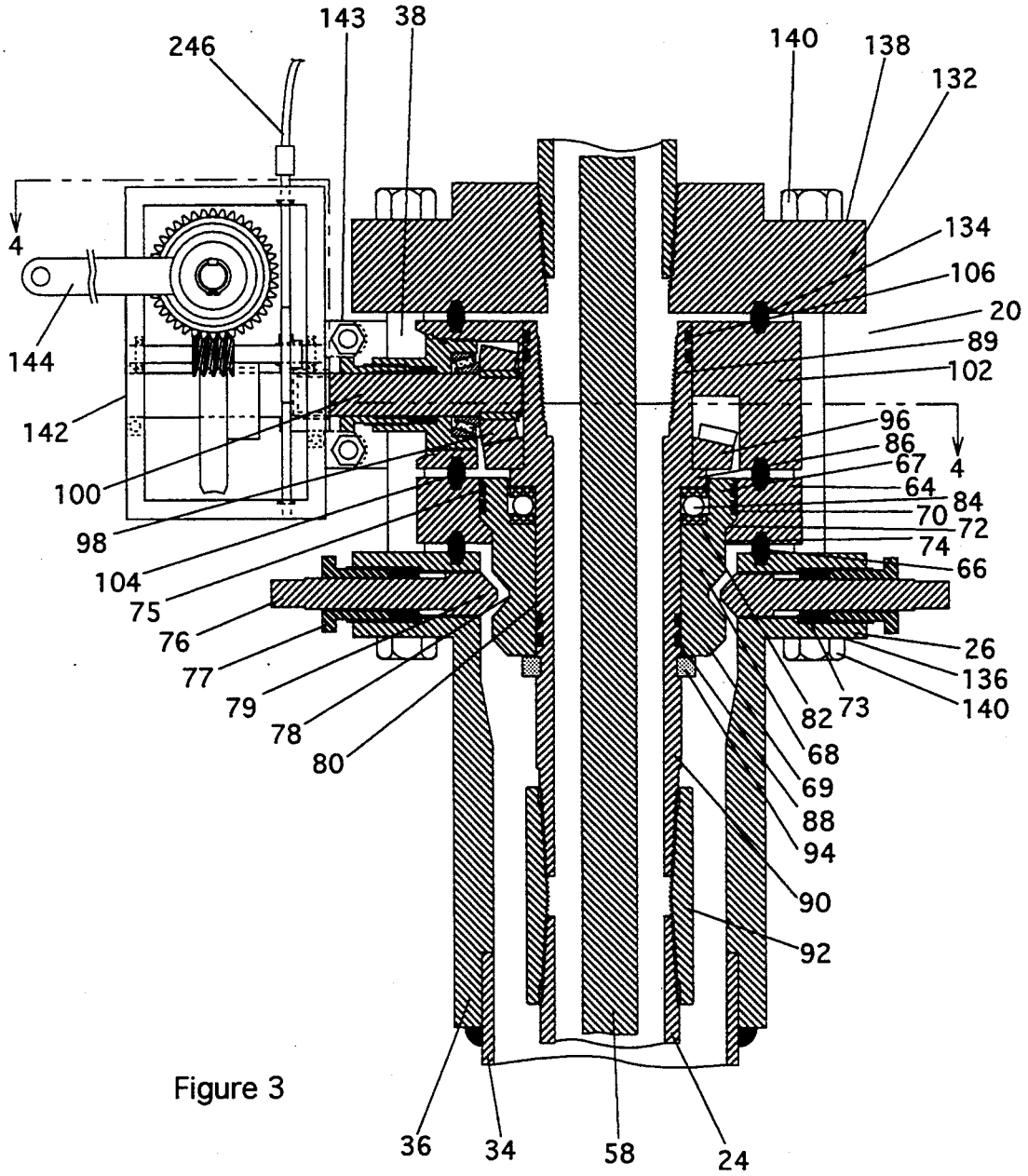
FIG. 3 is a longitudinal sectional view of the apparatus, attached to a wellhead, having the tubing string connected thereto and including a gear box containing means for creating a mechanical advantage.

The wellbore is typically completed by cementing a casing string (34) in at least the upper portion of the wellbore. Preferably, the wellhead flange (26) is comprised of a casing bowl (36), welded or screwed to the top of the casing string (34), having a flange at its uppermost surface. Referring to FIG. 3, the apparatus (20) is comprised of a support flange (64) for mounting on the wellhead flange (26). Thus, in the preferred embodiment, the support flange (64) rests upon and is supported by the wellhead flange (26), being the flange at the upper end of the casing bowl (36). A first seal ring (66) is located between the lower surface of the support flange (64) and the upper surface of the wellhead flange

(26) to prevent the passage of wellbore annulus fluids therebetween.

The support flange (64) is tubular in shape and is detachably engaged with the outer surface of the upper end (67) of a tubular outer member (68) such that the outer member (68) may be disengaged from the support flange (64) during servicing of the well. The inner surface of the support flange (64) is shaped to be compatible with the outer surface of the outer member (68) in order to facilitate sealing of the surfaces. The outer surface of the outer member (68) and the inner surface of the support flange (64) are shaped so that the outer member (68) is seated upon and supported by the support flange (64). The specific shape of the seating arrangement between the surfaces may vary from a gradual angled slope of the inner surface of the support flange (64) from its upper to its lower end to a vertical slope containing a protruding horizontal shoulder at a midpoint between the upper and lower ends. However, as shown in FIG. 3, in the preferred embodiment, the inner surface of the support flange (64) includes an upper vertical portion (70) and a lower vertical portion (74) with a protruding sloped or angled shoulder (72) between the two vertical portions (70, 74). The shoulder (72) supports the outer member (68) thereon while allowing more easy installation of the tubing string (24) into the wellbore. The tubing string (24) may be more easily hung up on a non-angled shoulder during its installation. The vertical portions (70, 74) facilitate a more secure fit between the outer member (68) and the support flange (64).

The outer surface of the upper end (67) of the outer member (68) and the inner surface of the support flange (64) are sealingly engaged at the upper vertical portion (70) of the support flange (64). The two surfaces are sealingly engaged by a sealing assembly comprised of two o-rings (75), mounted in o-ring grooves on the outer member (68).

The lower end (69) of the outer member (68) extends downward inside the wellhead flange (26) when the outer member (68) is mounted on the support flange (64). The shape of the lower end (69) of the outer member (68) is not dependent on the shape of the inner surface of the wellhead flange (26). Although the shapes of the outer surface of the lower end (69) of the outer member (68) and the inner surface of the wellhead flange (26) may be compatible to engage each other, this is neither necessary nor preferable. The two surfaces are not required to be sealingly engaged for operation of the apparatus (20). Further, in the preferred embodiment, the lower end (69) of the outer member (68) extends down from the wellhead flange (24), and specifically, into the casing bowl (36), without conforming to its shape in order that the apparatus (20) may be more easily retrofit to varying shapes and sizes of casing bowls (36) in existing wellheads.

Referring to FIG. 3, in the preferred embodiment, the wellhead flange (26) includes two holddown screws (76) which extend through the wellhead flange (26) through a bore from its outer surface to its inner surface. Each holddown screw (76) extends through a packing nut (77), which is held in place within the bore of the wellhead flange (26) by an outer threaded surface of the packing nut (77) compatible with an inner threaded surface of the bore of the wellhead flange (26). Packing (73) is located between the inner end of the packing nut (77) and an inwardly protruding shoulder on the bore of the wellhead flange (26). The nose (79) of the holddown screw (76) is similarly threaded on its outer surface in order that it is held in place within the bore of the wellhead flange (26) by the compatible inner threaded surface of the bore of the wellhead flange (26). The nose (79) of each holddown screw (76) is engagable with the lower end (69) of the outer member (68) when the outer member (68) is suspended from the support flange (64). The outer surface of the lower end of the outer member (68) includes a compatible engagement surface (78) for receiving the nose (79) of each holddown screw (76). The holddown screws (76) are threaded within the bore of the wellhead flange (26) to be adjustable so that the nose (79) may be received within the engagement surface (78). In this manner, the holddown screws (76) may be loosened or moved away from the engagement surface (78) in order to allow the outer member (68) to be removed. Conversely, the holddown screws (76) may be tightened and moved into engagement with the engagement surface (78) in order to prevent longitudinal movement of the outer member (68) relative to the wellhead flange.

A tubular inner mandrel (80) is rotatably supported within the outer member (68). The polished rod (58) is passed through the inner mandrel (80). The inner surface of the outer member (68) includes a shoulder (82) which extends towards the polished rod (58). A thrust bearing (84) is seated on the shoulder (82). A compatible shoulder (86) on the outer surface of the inner mandrel (80) is then seated on the thrust bearing (84) such that the inner mandrel (80) is rotatably supported upon the outer member (68). In this manner, the downward longitudinal movement of the inner mandrel (80) relative to the outer member (68) is inhibited. Preferably, the longitudinal axis of the inner member (80) substantially coincides with the longitudinal axis of the outer member (68).

The outer surface of the inner mandrel (80) sealingly engages the inner surface of the outer member (68) at a point adjacent to the lower end (69) of the outer member (68). The two surfaces are sealingly engaged by a sealing assembly comprised of two o-rings (88), mounted in o-ring grooves on the outer surface of the inner mandrel (80).

The inner mandrel (80) extends through the upper end (67) of the outer member (68) to an upper end (89). The inner surface of the upper end (89) of the inner mandrel (80) is threaded for connection to a tool during the servicing of the well in order to facilitate the removal of the inner mandrel (80). As well, the inner mandrel (80) extends through the lower end (69) of the outer member (68) to a lower end (90) for connecting to the tubing string (24). In the preferred embodiment, the lower end (90) of the inner mandrel (80) is threaded on its outer surface. A tubular tubing connector (92), having an inner threaded surface, is connected at one end to the lower end (90) of the inner mandrel (80). The other end of the tubing connector (92) is threadably engaged to an outer threaded surface at the upper end of the tubing string (24).

In the preferred embodiment, the apparatus (20) further includes means for securing the inner mandrel (80) to the outer member (68) such that upward longitudinal movement of the inner mandrel (80) relative to the outer member (68) is inhibited. The securing means are comprised of a retaining ring (94) secured to the inner mandrel (80) adjacent to the lower end (69) of the outer member (68). The retaining ring (94) is removable in order to permit upward longitudinal movement of the inner mandrel (80) relative to the outer member (68) as necessary for servicing.

Figure 4:
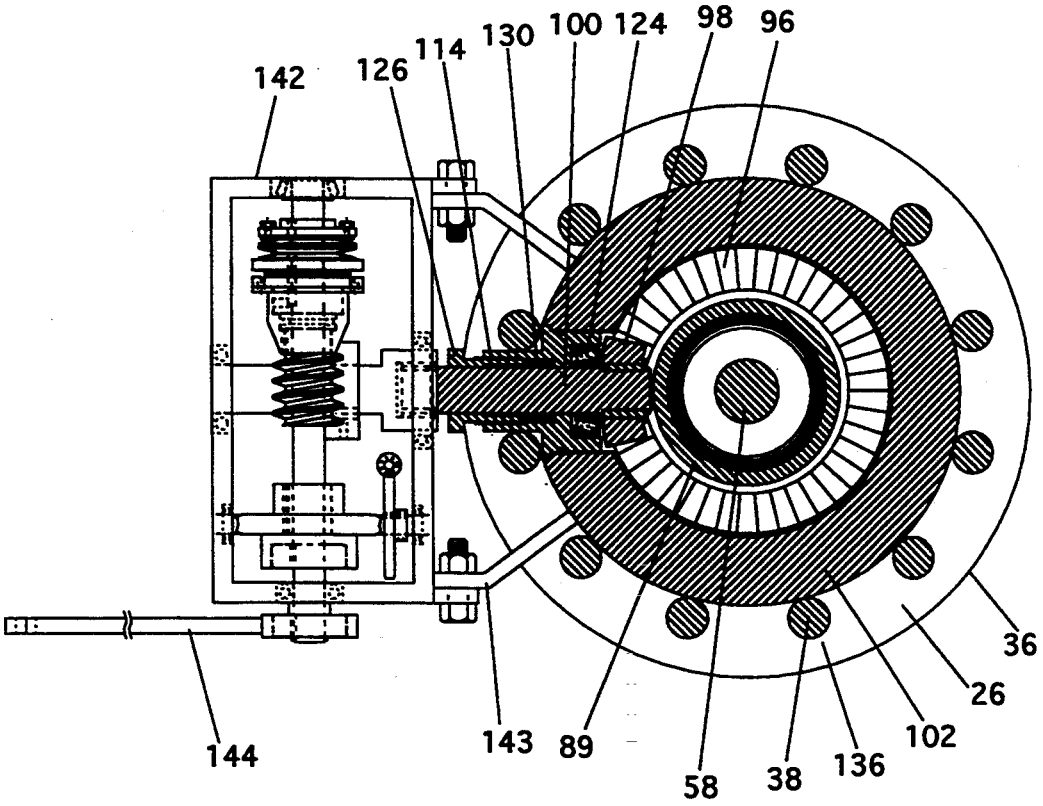
FIG. 4 is a cross-sectional view of the apparatus along line 4—4 of FIG. 3.

Referring to FIGS. 3 and 4, the apparatus (20) is further comprised of means for rotating the inner mandrel (80) within the outer member (68) while the outer member (68) remains stationary in order that the tubing string (24) is rotated within the wellbore. The rotating means are releasably engaged with the inner mandrel (80) in order that the rotating means may be released from engagement with the inner mandrel (80) during servicing. In the preferred embodiment, the inner mandrel (80) includes a crown gear (96) and the rotating means are comprised of a rotatable pinion (98) releasably engaged with the crown gear (96) and means for driving the pinion (98) such that rotation of the pinion (98) rotates the inner mandrel (80) within the outer member (68). Preferably, the crown gear (96) and the pinion (98) have a 3:1 ratio. A high gear ratio is preferable so that the size of the pinion shaft (100) and the torque on it can be reduced. In the preferred embodiment, the crown gear (96) has 45 teeth and the pinion (98) has 15 teeth. Preferably, the pinion (98) has no less than 15 teeth as undercutting of the root of the teeth would be required to get proper gear action. This weakens the teeth.

The crown gear (96) is integrally connected to the outer surface of the upper end (89) of the inner mandrel (80), adjacent to the upper end (67) of the outer member (68). As well, as shown in FIG. 4, the crown gear (96) faces in a upwards direction, away from the outer member (68). The teeth of the crown gear (96) and the pinion (98) are preferably cut to allow an amount of tolerance for movement of the crown gear (96) relative to the pinion (98). The driving means for the pinion (98) are comprised of a pinion shaft (100) connected to the pinion (98) and means for turning the pinion shaft (100). Preferably, the pinion shaft (100) is connected to the pinion (98) by four 3/16 inches×3/16 inches keys (99) spaced at 90°.

Referring to FIG. 3, a tubular housing (102) is removably mounted around the upper end (89) of the inner mandrel (80). The housing (102) provides a surface for supporting the portion of the wellhead (22) above the apparatus (20). The housing (102) is mounted upon the upper end of the support flange (64) and remains stationary during rotation of the inner mandrel (80). The lower end of the housing (102) and the upper end of the support flange (64) are sealingly engaged by a second seal ring (104). The uppermost end of the upper end (89) of the inner mandrel (80) is also sealingly engaged with a portion of the inner surface of the housing (102) by a sealing assembly. The sealing assembly includes two o-rings (106) mounted in o-ring grooves on the outer surface of the upper end (89) of the inner mandrel (80).

Figure 5:
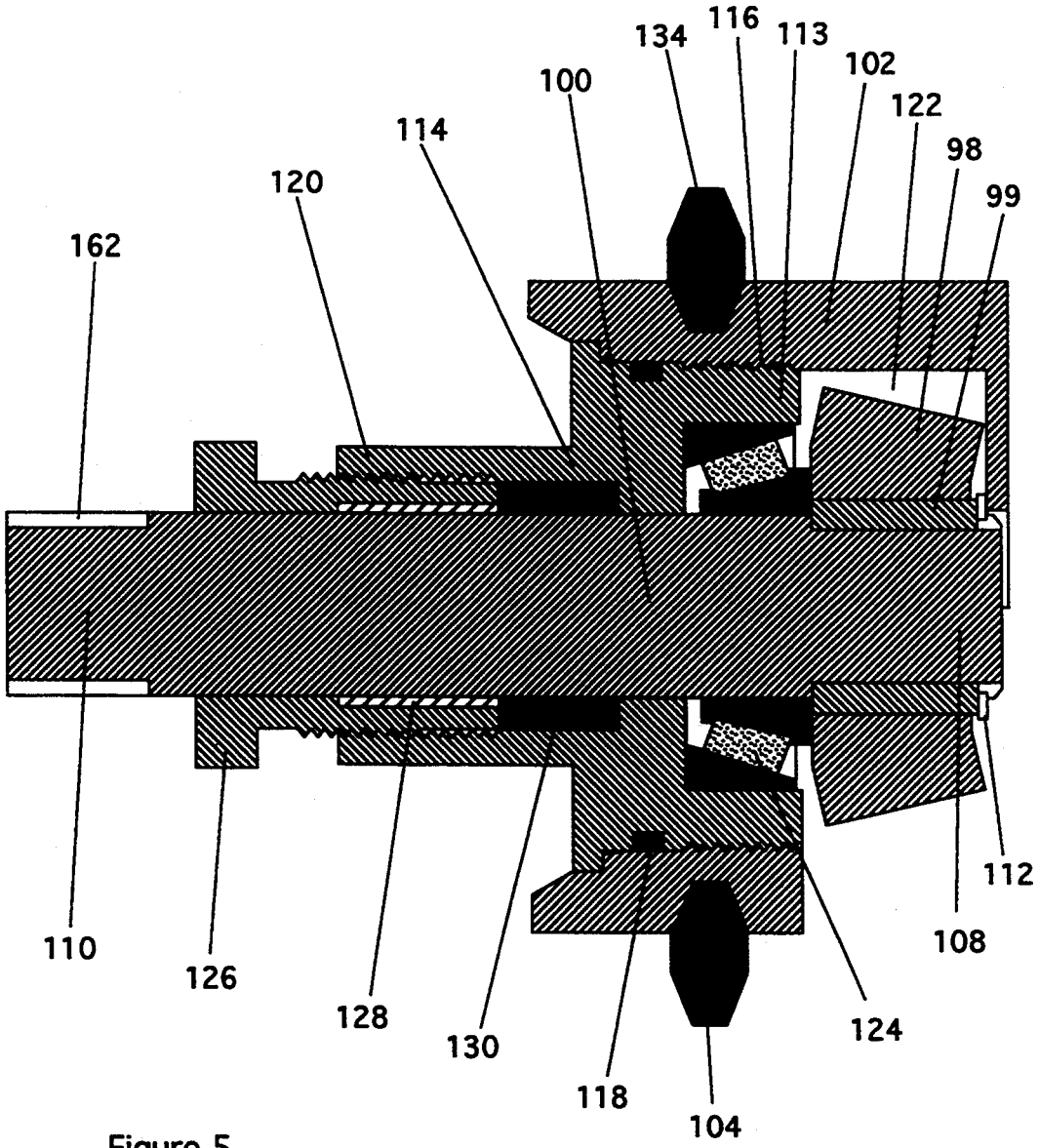
FIG. 5 is a detailed view of the rotating means of the apparatus shown in FIG. 4.

Referring to FIG. 5, the pinion shaft (100) has a first end (108) extending into the housing (102) for connection to the pinion (98) and a second end (110) outside of the housing (102) for connection to the driving means for the pinion shaft (100). The pinion (98) and the crown gear (96) are contained within the housing (102) (as shown in FIG. 3). The pinion (98) is attached to the first end (108) of the pinion shaft (100) by a snap ring (112) secured within a groove in the first end (108) of the pinion shaft (100).

As the pinion shaft (100) passes into the housing (102), the pinion shaft (100) is surrounded by a tubular pinion sleeve (114). The outer surface of a first end (113) of the pinion sleeve (114) is threadably engaged with a threaded portion (116) of the inner surface of the housing (102). As well, the surfaces are sealingly engaged by an o-ring (118) mounted in a groove on the outer surface of the pinion sleeve (114). A second end (120) of the pinion sleeve (114) extends outside of the housing (102).

The pinion shaft (100) passes through the pinion sleeve (114)into a pinion cavity (122) within the housing (102) for containing the pinion (98). The pinion shaft (100) is rotatably supported within the pinion sleeve (114) by a thrust bearing (124). In addition, the pinion shaft (100) is held within the pinion sleeve (114) by a tubular packing nut (126). The pinion shaft (100) extends through the packing nut (126) which is threaded into the second end (120) of the pinion sleeve (114). The inner surface of the packing nut (126) includes a bronze bushing (128) and packing (130) to secure the pinion shaft (100).

Referring to FIGS. 2 and 3, the wellhead (22) is further comprised of a tubular adaptor flange (132). The lower end of the adaptor flange (132) is mounted upon the upper end of the housing (102) and sealingly engaged by a third seal ring (134). The upper end of the adaptor flange (132) serves as a support for the remainder of the wellhead (22) above the adaptor flange (132). As well, the adaptor flange (132) is attached to the wellhead flange (26) by means of fasteners such that the housing (102) and the support flange (64) may be secured or firmly held between the adaptor flange (132) and the wellhead flange (26).

Referring to FIG. 4, in the preferred embodiment, the wellhead flange (26) defines more than one aperture forming a first bolt ring (136) for receiving fasteners (38), preferably bolts, therein. Referring to FIG. 3, the adaptor flange (132) defines more than one aperture forming a second bolt ring (138) compatible with the first bolt ring (136) for receiving fasteners (38) therein. A fastener (38) may then be extended through each aperture in the first bolt ring (136) to the compatible aperture in the second bolt ring (138) and fixed in place, such as by nuts (140) at each end of the bolts (38).

The inner diameter of the first bolt ring (136) and the inner diameter of the second bolt ring (138) define the diameter of a cylindrical space. In the preferred embodiment, the housing (102), the inner mandrel (80), and the outer member (68) are all contained within the diameter of the cylindrical space. It is preferred that the housing (102), the inner mandrel (80) and the outer member (68) are within the bolt rings (136, 138) in order that they do not interfere with the placement of fasteners (38) into the bolt rings (136, 138). Where the housing (102) interferes with the fasteners (38), the housing (102) may be furnished with apertures or grooves that are compatible with the bolt rings (136, 138). However, by having the housing (102), the inner mandrel (80) and the outer member (68) all contained within the diameter of the cylindrical space defined by the bolt rings (136, 138), the apparatus (20) is more easily retrofit to an existing wellhead (22).

Further, in the preferred embodiment, the support flange (64) is also contained within the diameter of the cylindrical space for the same reasons. However, it is permissible for the support flange (64) to extend outside the diameter of the cylindrical space provided the support flange (64) defines a bolt ring compatible with the first and second bolt rings (136, 138), either by grooves or by apertures.

The apparatus (20) allows the rotating means, including the pinion (98), to be released from the crown gear (96) on the inner mandrel (80) and the housing (102) to be removed from the support flange (64) so that a blowout preventer (not shown) may be installed for servicing. The blowout preventer is installed by placing it on top of the support flange (64) and over the inner mandrel (80) and the outer member (68) and sealingly engaging it with the support flange (64) by the first seal ring (66). The blowout preventer is then fastened to the wellhead flange (26) by fasteners (38) such as bolts, extending from the blowout preventer to the first bolt ring (136). Thus, the support flange (64) is secured between the blowout preventer and the wellhead flange (26). If the support flange (64) extends beyond the diameter of the cylindrical space, the fasteners (38) extend from the blowout preventer through grooves or apertures in the support flange (64) to the first bolt ring (136). Once the blowout preventer is secured in place by the fasteners (38), the holddown screws (76) are released from engagement with the engagement surface (78) and the outer member (68) and the inner mandrel (80) may be pulled through the blowout preventer, along with the tubing string (24), in order to service the well. Thus, the tubing string (24) is not moved until the blowout preventer is secured in place.

In operation, the apparatus (20) causes the clockwise rotation of the tubing string (24) in order to facilitate the tightening of the various joints in the tubing string (24). Further, the apparatus (20) preferably rotates the tubing string (24) at a rate of about 3 to 5 revolutions per day. This rotation rate provides sufficient rotation to provide even wear distribution of the inner surface of the tubing string (24), while minimizing the expended energy required to rotate the tubing string (24) and minimizing the wear on the outer surface of the tubing string (24), inner surface of the casing string (34), various seals and other pads of the apparatus (20). However, the number of revolutions per day may be varied as desired.

The turning means for the pinion shaft (100) may be operated manually, or may be driven automatically by the reciprocating action of a walking beam (54) as shown in FIG. 2, or by the rotation of a rotating polished rod (58) as shown in FIG. 1. In the preferred embodiment, the turning means are driven by the rotation of a rotating polished rod (58). In all modes of operation, the turning means are comprised of means for creating a mechanical advantage which are operably and releasably connected to the driving means, and specifically the pinion shaft (100). The mechanical advantage creating means facilitate the generation of sufficient torque to turn the pinion shaft (100) in order to rotate the inner mandrel (80) and the tubing string (24). Preferably the mechanical advantage creating means are comprised of at least one set of gears contained in a gear box (142). The gear box (142) is attached to the housing (102) by gear box supports (143).

Figure 6:
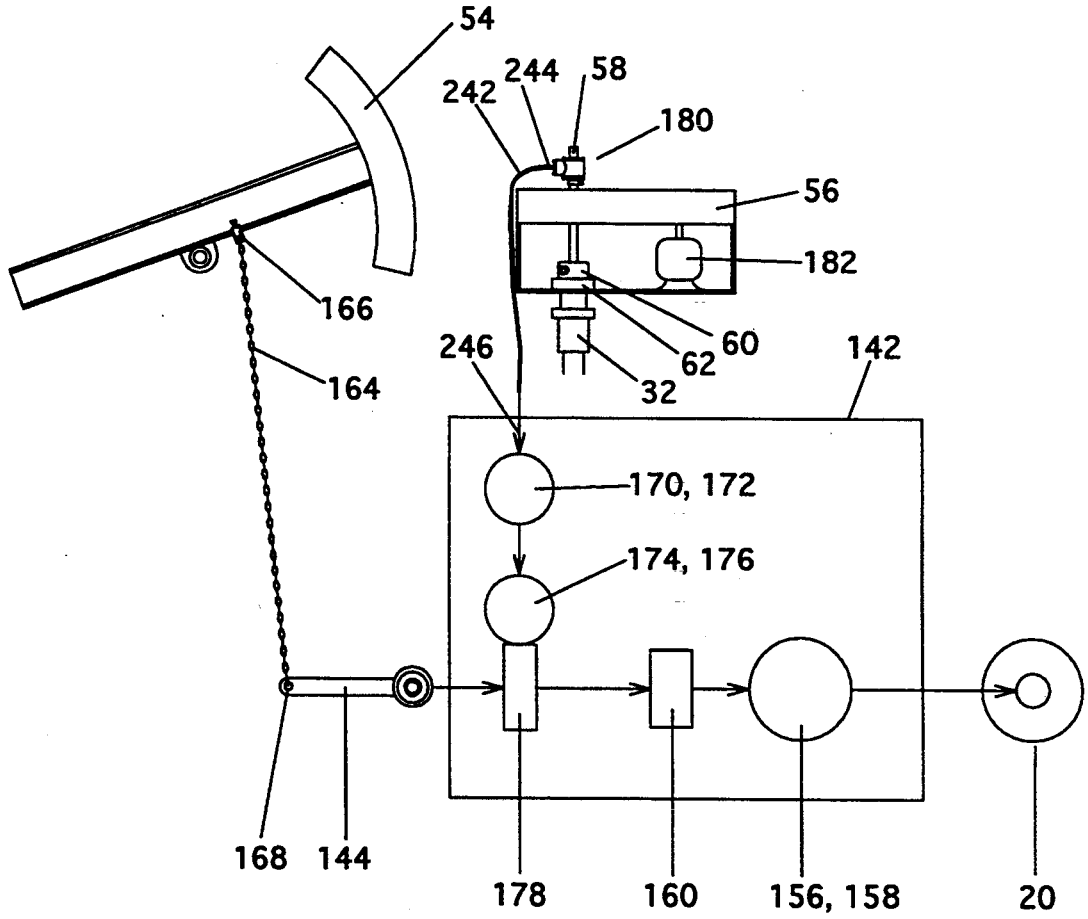
FIG. 6 is a schematic diagram showing the connections of the apparatus to the mechanical advantage creating means contained within the gear box for a wellhead having either a rotating rod with an adaptor or a reciprocating rod with a walking beam.
Figure 7:
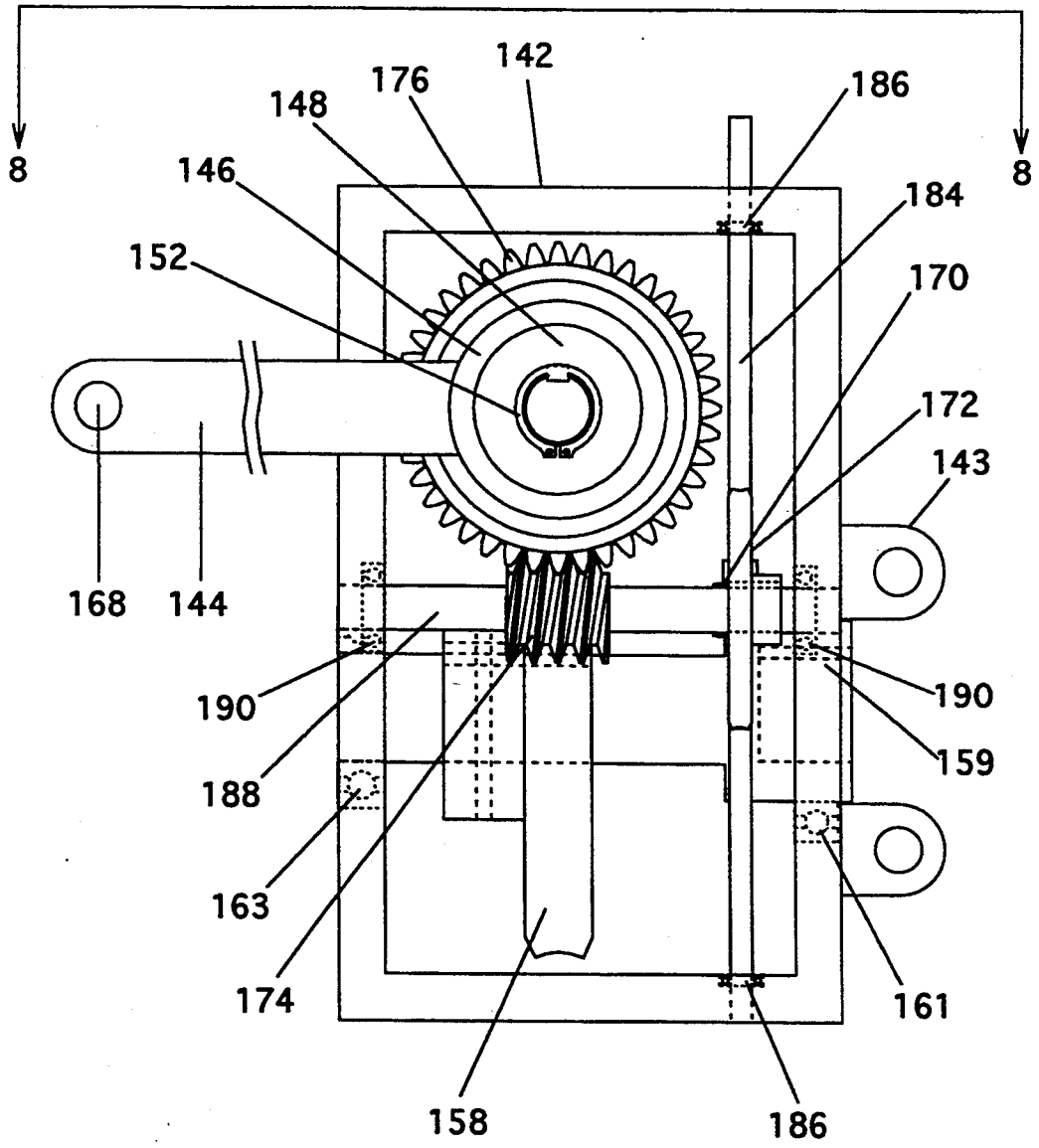
FIG. 7 is a detailed end view of the gear box as shown in FIG. 3, having the wall cut away.
Figure 8:
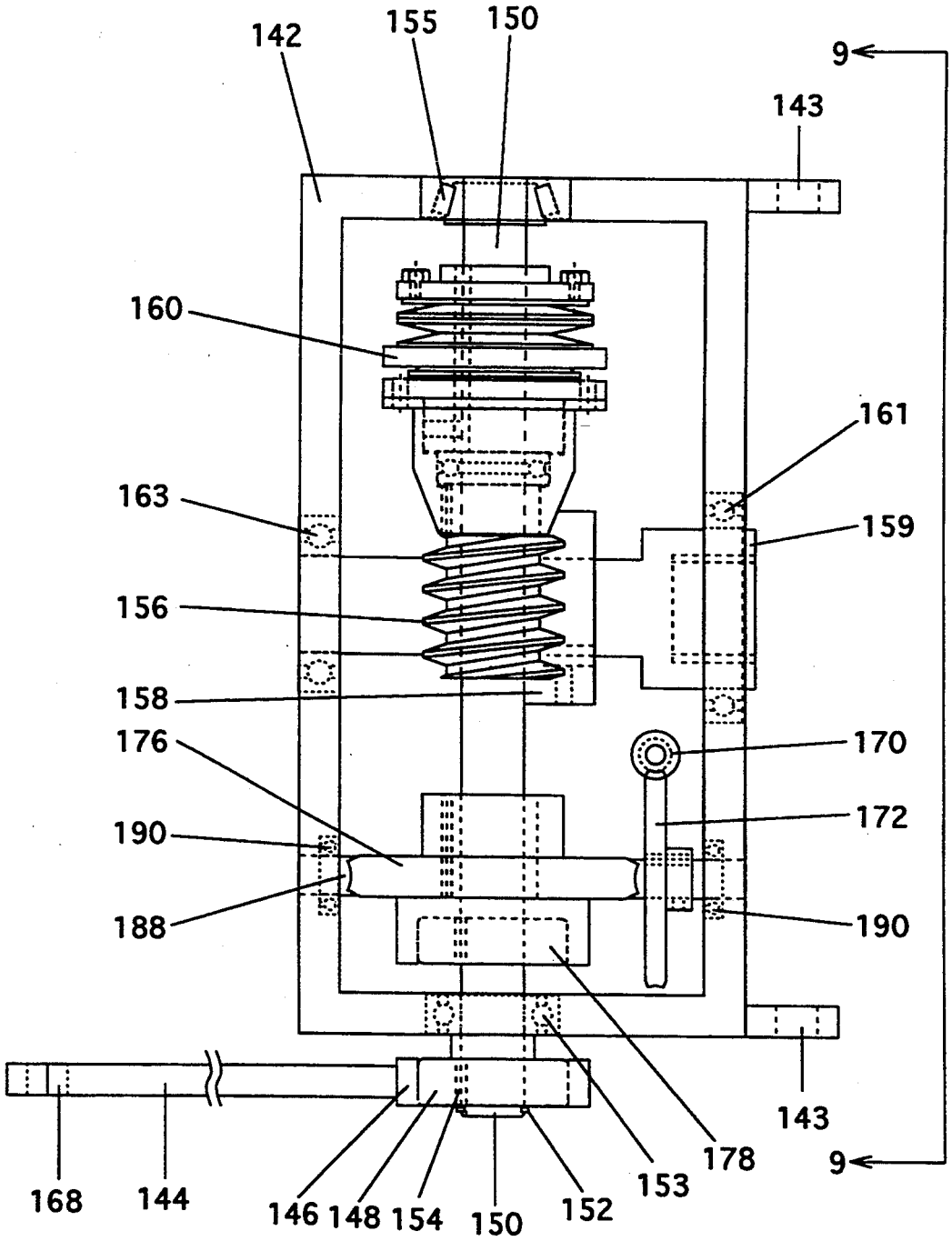
FIG. 8 is a detailed top view of the gear box, having the wall cut away, in the direction of line 8—8 of FIG. 7.
Figure 9:
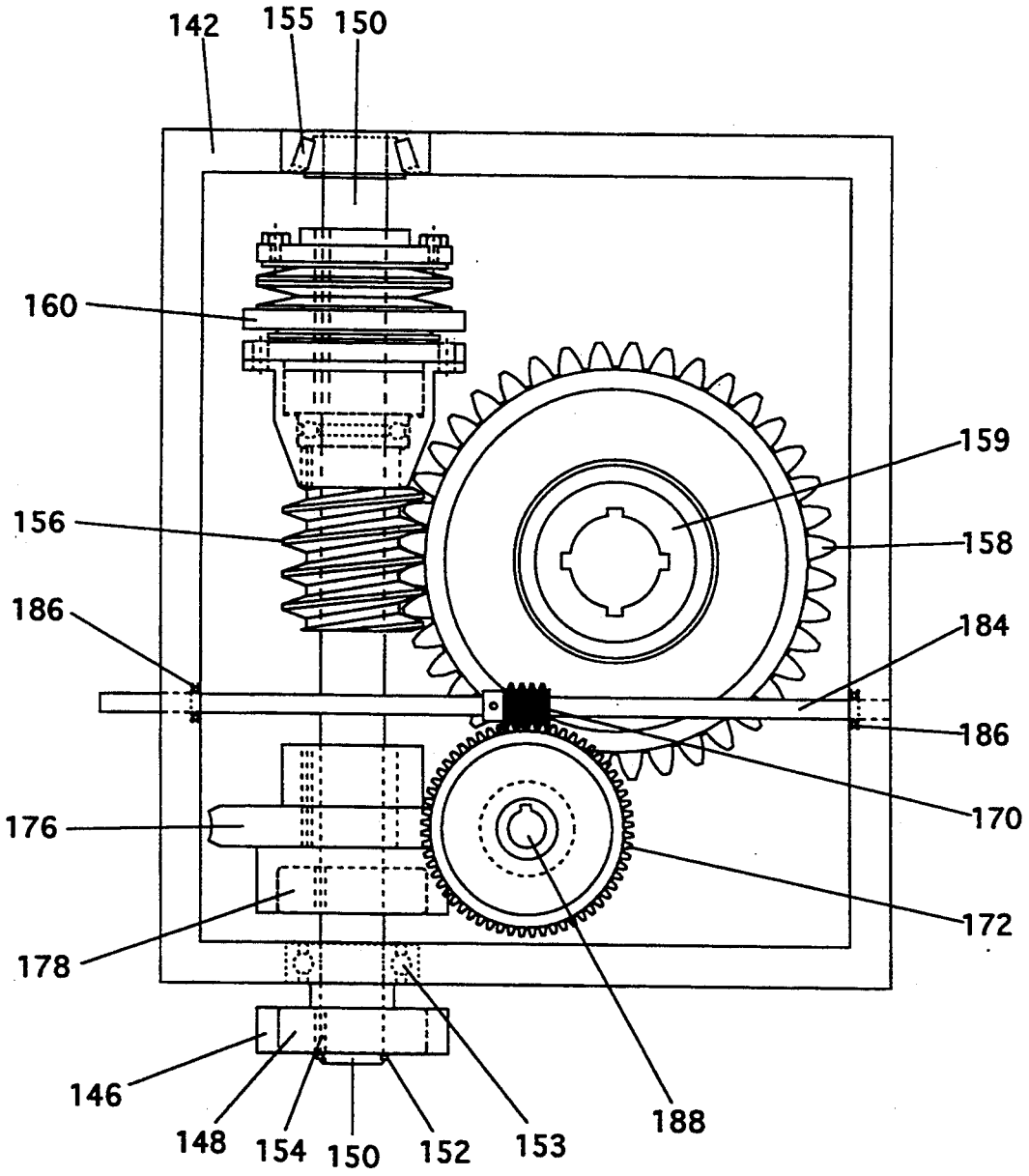
FIG. 9 is a detailed side view of the gear box, having the wall cut away, in the direction of line 9—9 of FIG. 8.

While it is preferable for the apparatus (20) to be driven automatically by either a walking beam (54) or rotating polished rod (58), it is desirable to be able to rotate the tubing string (24) manually from time to time to check the torque required to rotate the tubing string (24). The amount of torque required may indicate if the tubing string (24) is becoming stuck from sand accumulation in the wellbore or other problems. At least one set of gears is used to facilitate the manual operation of the turning means. Referring to FIGS. 6 and 7, a drive handle (144), which may be reciprocated by hand, is welded to a drive handle housing (146), which is operatively connected by a press fit to an indexing clutch (148). The indexing clutch (148) is preferably a GMN Co. Freewheel Clutch, model FKN 6205, and is connected to one end of a first gear shaft (150) by a snap ring (152) and key (154), as shown in FIGS. 8 and 9. The indexing clutch (148) acts as a ratchet so as to enable the drive handle (144) to drop down freely once it has been raised manually, or by the walking beam (54) as described below. Referring to FIGS. 8 and 9, one end of the first gear shaft (150) is rotatably supported in a support bearing (153) and the other end is rotatably supported in a thrust bearing (155) mounted in the gear box (142). The first gear shaft (150) is equipped with a first worm (156) which is operatively engaged with a first worm gear (158). The first worm gear (158) is preferably a 40 tooth, 8 diametral pitch worm gear. The first worm gear (158) is operatively connected to the pinion shaft (100) by a female wellhead connector (159) for receiving the male pinion shaft (100) having four keys (162) spaced at 90°, as shown in FIG. 5. The wellhead connector (159) is rotatably supported by the gear box (142) by support bearings (161,163), preferably deep groove ball bearings, as shown in FIGS. 7 and 8.

In the preferred embodiment, a torque limiter (160) is connected between the first gear shaft (150) and the first worm gear (158) for limiting the torque generated by the turning means in order to inhibit the generation of torque sufficient to cause damage to the gear box (142), the apparatus (20), or the tubing string (24) when the tubing string (24) becomes stuck. The torque limiter (160) may be adjusted and set to slip at a predetermined torque value in order to avoid any damage. In the preferred embodiment, the torque limiter (160) is a Mayr Co. OPTI Ball Detent Torque Limiter Size 1. The output torque from the preferred torque limiter (160) can be adjusted from 4.4 foot - pounds to a maximum torque of 59 foot - pounds.

In the preferred embodiment, the gear ratio between the drive handle (144) and the tubing string (24) is 120:1. Typically, however the mechanical efficiency of the first worm gear (158) and first worm (156) is about 40 percent and the crown gear (96) and pinion (98) are about 90 percent. Thus, the overall mechanical advantage is about 43:1 and a torque of 59 foot - pounds at the drive handle (144) will produce a torque output to the tubing string (24) of about 2537 foot - pounds, which is just under the maximum allowable makeup torque of a $3\frac{1}{2}$ inch tubing string. Torque above 2,850 foot - pounds can result in damage to the tubing string (24) or tubing coupling threads or splitting of the tubing coupling. A $3\frac{1}{2}$ inch tubing string (24) is normally considered to be large for producing wells. Smaller $2\frac{7}{8}$ inches or $2\frac{3}{8}$ inches tubing string (24) can withstand lesser amounts of torque. The torque limiter (160) is therefore adjusted so torque output from the gear box (142) does not cause the maximum allowable makeup torque of the specific tubing string (24) to be exceeded. The torque limiter (160) is positioned in the gearing system to protect the tubing string (24), gear box (142) and apparatus (20) whether the turning means are operable manually by the drive handle (144) or by a walking beam (54) or rotating polished rod (58).

Referring to FIG. 6, when the turning means are operable by a walking beam (54), the reciprocating or rocking action of the walking beam (54) is translated to the drive handle (144). One end of a chain (164) is connected to the walking beam (54) by a chain attachment fitting (166). The other end is connected to a hole (168) in the drive handle (144). The chain attachment fitting (166) is positioned on the walking beam (54) such that the rocking action of the walking beam (54) will result in an angular rotation of the drive handle (144) of about 15 degrees. Each oscillation of the walking beam (54) and the drive handle (144) results in the indexing clutch (148) advancing the first gear shaft (150) 15 degrees. On average reciprocating wellheads (22) operate at about 6 strokes per minute in wells producing heavy oil and sand. The gear ratio of the first worm and worm gear (156, 158) is such that when the chain attachment fitting (166) is adjusted for 15 degrees indexing of the indexing clutch (148), the tubing string (24) will be rotated about 3 turns per day. The chain attachment fitting (166) may be adjusted to vary the angular rotation of the drive handle (144) and thus the number of revolutions of the tubing string (24) per day.

Referring to FIG. 6, where the turning means are operable by a rotating polished rod (58), the mechanical advantage creating means contained within the gear box (142) further include a second worm and worm gear (170, 172), a third worm and worm gear (174, 176) and a freewheel clutch (178). Thus the mechanical advantage creating means are comprised of three worm and worm gear sets in series such that the torque generated by the rotating polished rod (58) is stepped up by the mechanical advantage creating means in stages to a level sufficient to rotate the tubing string (24). In addition, the apparatus is further comprised of an adaptor (180) for operatively connecting the rotating polished rod (58) to the mechanical advantage creating means such that rotation of the polished rod (58) turns the pinion shaft (100). Referring to FIGS. 1 and 6, the upper end of the rotating polished rod (58) is held by the rod clamp (60). The rod clamp (60) is supported from a thrust bearing plate (62) forming part of the rotary pump drive (56). A hydraulic or electric drive motor (182) causes the polished rod (58) to rotate.

Referring to FIGS. 7 and 9, the adaptor (180) is connected to a second gear shaft (184) which is rotatably supported by the gear box (142) by support bearings (186), preferably deep groove ball bearings. The second gear shaft (184) is equipped with the second worm (170), which is operatively engaged with the second worm gear (172), as shown in FIGS. 7, 8 and 9. The second worm gear (172) is preferably a 60 tooth, 24 diametral pitch worm gear. The second worm gear (172) is mounted on a third gear shaft (188). The third gear shaft (188) is similarly rotatably supported by the gear box (142) by support bearings (190), preferably deep groove ball bearings. The third gear shaft (188) is equipped with the third worm (174), which is operatively engaged with the third worm gear (176). The third worm gear (176) is preferably a 40 tooth, 12 diametral pitch worm gear. The freewheel clutch (178) disengages the third worm gear (176) while the turning means are being operated manually by the drive handle (144) or by the walking beam (54). Preferably, the freewheel clutch (178) is a GMN Co. Freewheel Clutch, Model FKN 6205 capable of 69 foot - pounds of torque. The third worm gear (176) is mounted on the first gear shaft (150). The remainder of the structure and operation of the first worm and worm gear (156, 158) and the torque limiter (160) are the same as that described above for operation of the turning means either manually or by the action of the walking beam (54).

Figure 10:
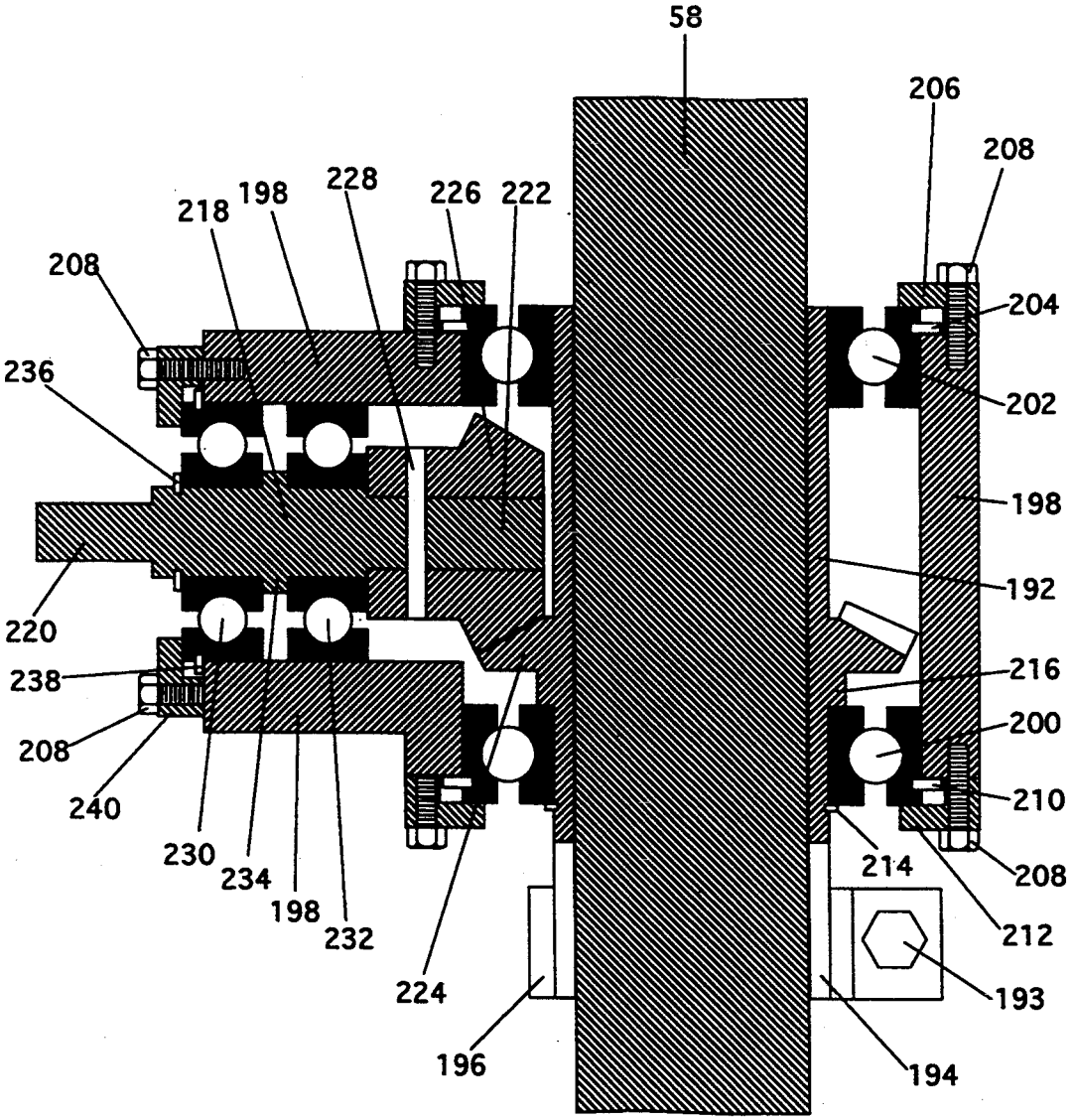
FIG. 10 is a detailed longitudinal sectional view of the adaptor shown in FIG. 1.

Referring to FIG. 10, the adaptor (180) is comprised of a tubular sleeve (192) which is fixedly mountable on the rotating polished rod (58) such that the polished rod (58) is contained within the sleeve (192) and rotation of the polished rod (58) rotates the sleeve (192). The sleeve (192) is fixedly mounted by a releasable clamping ring (196) which is secured about the lower end of the sleeve (192) by a fastener, such as a bolt and nut (193). Clamping of the clamp ring (196) is facilitated by a plurality of longitudinal cuts (194) in the lower end of the sleeve (192) where the clamping ring (196)is secured.

The adaptor (180) is further comprised of a first adaptor shaft (218) having a connector end (220) and a drive end (222). The drive end (222) is releasably engaged with the sleeve (192) such that rotation of the sleeve (192) rotates the first adaptor shaft (218). A tubular adaptor housing (198) for supporting the drive end (222) of the first adaptor shaft (218) is mounted about the sleeve (192) such that the sleeve (192) is rotatable within the adaptor housing (198) while the adaptor housing (198) remains stationary. Two support bearings (200, 202) are located between the sleeve (192) and the adaptor housing (198) such that the sleeve (192) is rotatable within the stationary adaptor housing (198). The support bearings (200, 202), preferably deep groove ball bearings, provide radial and thrust support.

The inner surface of the upper support bearing (202) is abutted against the outer surface of the upper end of the sleeve (192) by a first snap ring (204) mounted in a groove on the outer surface of the upper support bearing (202). The first snap ring (204) is supported by the adaptor housing (198) and inhibits the downward longitudinal movement of the upper support bearing (202) relative to the adaptor housing (198). The inner surface of the upper end of the adaptor housing (198) is secured against the outer surface of the upper support bearing (202) by a first retainer ring (206) attached to the adaptor housing (198) by stud bolts (208). The first retainer ring (206) abuts against the upper end of the upper support bearing (202) and inhibits its upward longitudinal movement relative to the adaptor housing (198). As mounted, the upper support bearing (202) provides radial support to the upper end of the sleeve (192).

The inner surface of the lower support bearing (200) is abutted against the outer surface of the lower end of the sleeve (192) above the longitudinal cuts (194) by a second snap ring (210) mounted in a groove on the outer surface of the lower support bearing (200). The second snap ring (210) abuts against the adaptor housing (198) such that the second snap ring (210)inhibits the upward longitudinal movement of the lower support bearing (200) relative to the adaptor housing (198). The inner surface of the lower end of the adaptor housing (198) is secured against the outer surface of the lower support bearing (200) by a second retainer ring (212) attached to the adaptor housing (198) by stud bolts (208). The second retainer ring (212) abuts against the lower end of the lower support bearing (200) and inhibits the downward longitudinal movement of the lower support bearing (200) relative to the adaptor housing (198).

A third snap ring (214) abuts against the lower end of the lower support bearing (200) and is mounted in a groove on the adjacent outer surface of the sleeve (192). The third snap ring (214) inhibits the upward longitudinal movement of the sleeve (192) relative to the lower support bearing (200).

The outer surface of the sleeve (192) includes a protruding shoulder (216). The shoulder (216) is seated on the upper end of the lower support bearing (200) such that the sleeve (192) is rotatably supported thereon. Further, the shoulder (216) inhibits the downward longitudinal movement of the sleeve (192) relative to the lower support bearing (200). As mounted, the lower support bearing (200) provides radial and thrust support to the lower end of the sleeve (192).

In the preferred embodiment, the outer surface of the sleeve (192) includes an upwardly facing crown gear (224). Preferably the crown gear (224) is a metric module 2.0 with 36 teeth and a pitch diameter of 73.8 mm. The minimum diameter of the crown gear (224) is limited by the diameter of the polished rod (58). The crown gear (224) engages a pinion (226) connected to the drive end (222) of the first adaptor shaft (218). Preferably the pinion is a metric module 2.0 with 18 teeth. Preferably, the crown gear (224) and the pinion (226) have a 2:1 ratio. At a 2:1 ratio, the adaptor housing (198) is relatively compact and the pinion gear speed is kept relatively low minimizing the wear on parts of the adaptor (180) and the operative means connecting it to the apparatus (20). The pinion (226) is affixed to the first adaptor shaft (218) by a slotted spring pin (228).

The first adaptor shaft (218) is rotatably supported within the adaptor housing (198) substantially perpendicular to the sleeve (192) by two support bearings (230, 232). The support bearings (230, 232) are located along the length of the first adaptor shaft (218) between the first adaptor shaft (218) and the adaptor housing (198). The support bearings (230, 232) are separated by an outward protruding shoulder (234) on the first adaptor shaft (218). The inner support bearing (232) is fixed between the pinion (226) and the shoulder (234) and inhibited from movement relative to the first adaptor shaft (218). The outer support bearing (230) is fixed between the shoulder (234) and a fourth snap ring (236) and is inhibited from movement relative to the first adaptor shaft (218). The fourth snap ring (236) is mounted in a groove on the first adaptor shaft (218). Further, a fifth snap ring (238) is mounted in a groove on the outer support bearing (230) facing towards the adaptor housing (198). The fifth snap ring (238) abuts against the adaptor housing (198) and inhibits movement of the outer support bearing (230) relative to the adaptor housing (198) in the direction of the drive end (222) of the first adaptor shaft (218). Finally, a third retainer ring (240) is affixed to the adaptor housing (198) by stud bolts (208) at the end nearest the connector end (220) of the first adaptor shaft (218). The outer support bearing (230) abuts against the inner surface of the third retainer ring (240) and inhibits movement of the outer support bearing (230) relative to the adaptor housing (198) in the direction of the connector end (220) of the first adaptor shaft (218). As mounted, the outer support bearing (230) provides both radial and thrust support to the first adaptor shaft (218), while the inner support bearing (232) provides radial support.

The adaptor (180) is further comprised of means for operatively connecting the first adaptor shaft (218) to the rotating means of the apparatus (20) so that rotation of the polished rod (58) rotates the tubing string (24). Referring to FIG. 1, in the preferred embodiment, the connecting means are comprised of a flexible second adaptor shaft (242). The second adaptor shaft (242) has a first end (244) operatively connected to the connector end (220) of the first adaptor shaft (218) such that rotation of the first adaptor shaft (218) rotates the second flexible adaptor shaft (242). The second adaptor shaft (242) has a second end (246) operatively connected to the mechanical advantage creating means, and specifically to the second gear shaft (184), so that the torque generated by rotation of the second adaptor shaft (242) is translated to sufficient torque to rotate the rotating means for operating the apparatus (20), and specifically the pinion shaft (100). Alternatively, the adaptor (180) may be used to drive any type of apparatus having a rotating means for operating the apparatus and, if necessary, means, operatively connected to the rotating means, for creating a mechanical advantage to facilitate the generation of sufficient torque to operate or engage the rotating means.

In the preferred embodiment, the polished rod (58) rotates to the right or in a clockwise direction, which results in a corresponding clockwise rotation of the tubing string (24) in order to facilitate tightening of the various joints in the tubing string (24). Where the polished rod (58) rotates to the left or in a counter clockwise direction, the adaptor (180), and specifically the sleeve (192), should be inverted on the polished rod (58) so that the tubing string (24) continues to be rotated in a clockwise direction.

Typically, the polished rod (58) and the sucker rod (52) are rotated in the order of 75 to 450 rotations per minute (rpm) with the average being about 300 rpm. The output rpm of the adaptor (180) is preferably double that of the polished rod (58). Thus, the output of the first adaptor shaft (218) is about 600 rpm. Therefore, in the preferred embodiment, the second adaptor shaft (242) also operates at about 600 rpm.

The gear box (142) contains three sets of worms (156, 170, 174) and worm gears (158, 172, 176) in series that have gear ratios 40:1, 60:1 and 40:1 respectively which result in a total gear ratio of 96,000:1. This means that the output rpm to the apparatus (20) is only about 9 revolutions per day. With a preferred 3:1 ratio of the crown gear (96) and pinion (98) in the apparatus (20), the overall gear ratio is about 288,000:1 so that the tubing string (24) is turned about 3 revolutions per day. Assuming that the mechanical efficiency of a worm and worm gear set is in the order of about 40 percent, while a crown gear and pinion is in the order of about 90 percent, the overall mechanical advantage of the apparatus (20) and the gear box (142) is therefore less than about 288,000:1. The overall mechanical advantage is calculated as $288{,}000\times0.40\times0.40\times0.40\times0.90$ to equal 16,589:1. The maximum torque therefore required at the second adaptor shaft (242) is about 2,850 foot - pounds divided by 16,589 which equals about 0.17 foot - pounds or 2.1 inch pounds. Preferably, the second adaptor shaft (242) is an Elliott Manufacturing ¼ inch diameter shaft no. B401-8417. This model of second adaptor shaft (242) is capable of over 10 inch - pounds of dynamic torque and 6,000 rpm, which well satisfies the above noted torque requirements.

Although the preferred gear ratios are set out herein, any combination of gears and gear ratios able to translate the torque generated by the second adaptor shaft (242) to a sufficient torque to operate the rotating means of the apparatus (20) may be used.

The embodiments of the invention in which an exclusive property or privilege is claimed are defined as follows:

1. An apparatus for attachment to a wellhead for suspending and rotating a tubing string contained within a wellbore, the wellhead having a wellhead flange, the apparatus comprising:

(a) a support flange for mounting on the wellhead flange;

(b) a tubular outer member having an upper end for detachably engaging the support flange such that the outer member is suspended therefrom and a lower end for extending into the wellbore;

(c) a tubular inner mandrel rotatably supported within the outer member such that at least the downward longitudinal movement of the inner mandrel relative to the outer member is inhibited, the inner mandrel having an upper end and a lower end extending through the lower end of the outer member for connecting to the tubing string;

(d) means, releasably engagable with the upper end of the inner mandrel, for rotating the inner mandrel and the tubing string while the outer member remains stationary; and (e) a tubular housing removably mounted around the upper end of the inner mandrel for supporting the portion of the wellhead above the apparatus;

wherein the rotating means are releasable from the inner mandrel and the housing is removable so that a blowout preventer may be placed on top of the support flange and over the outer member and the inner mandrel and mounted on the wellhead without first moving the tubing string and so that the outer member, the inner mandrel and the tubing string may be pulled through the blowout preventer in order to service the well.

2. The apparatus as claimed in claim 1 wherein the wellhead flange includes at least one adjustable holddown screw for engagement with the outer member and the outer surface of the lower end of the outer member includes a compatible engagement surface for receiving the holddown screw such that when the holddown screw is adjusted to be received within the engagement surface, longitudinal movement of the outer member relative to the wellhead flange is inhibited.

3. The apparatus as claimed in claim 1 further comprising means for securing the inner mandrel to the outer member such that upward longitudinal movement of the inner mandrel relative to the outer member is inhibited.

4. The apparatus as claimed in claim 3 wherein the securing means are comprised of a retaining ring secured to the inner mandrel adjacent to the lower end of the outer member.

5. The apparatus as claimed in claim 4 wherein the retaining ring is removable to permit upward longitudinal movement of the inner mandrel relative to the outer member.

6. The apparatus as claimed in claim 1 wherein the wellhead flange defines more than one aperture forming a first bolt ring for receiving fasteners therein and the wellhead further comprises a tubular adaptor flange mountable on the upper surface of the housing such that when the apparatus is attached to the wellhead, the housing and the support flange are located between the adaptor flange and the wellhead flange, the adaptor flange defining more than one aperture forming a second bolt ring compatible with the first bolt ring, the housing, and the support flange such that fasteners can be extended through the apertures in the adaptor flange and the wellhead flange in order to secure the housing and the support flange between the adaptor flange and the wellhead flange.

7. The apparatus as claimed in claim 6 wherein the inner diameters of the first bolt ring and the second bolt ring define the diameter of a cylindrical space, and the housing, the inner mandrel and the outer member are contained completely within the diameter.

8. The apparatus as claimed in claim 7 wherein the support flange is contained completely within the diameter of the cylindrical space.

9. The apparatus as claimed in claim 1 wherein the inner mandrel is rotatably supported within the outer member by a thrust bearing located between the inner mandrel and the outer member such that the thrust bearing is seated on the outer member and the inner mandrel is rotatably supported upon the thrust bearing.

10. The apparatus as claimed in claim 1 wherein the wellbore includes a casing string for containing the tubing string and the wellhead flange is located at the upper end of the casing string.

11. The apparatus as claimed in claim 1 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

12. The apparatus as claimed in claim 11 wherein the inner mandrel extends through the upper end of the outer member for connecting to the crown gear.

13. The apparatus as claimed in claim 11 wherein the crown gear is integral with the inner mandrel.

14. The apparatus as claimed in claim 11 wherein the driving means are comprised of a pinion shaft extending into the housing for connection to the pinion and means for turning the pinion shaft.

15. The apparatus as claimed in claim 14 wherein the turning means are comprised of means operatively and releasably connected to the pinion shaft for creating a mechanical advantage to facilitate the generation of sufficient torque to turn the pinion shaft in order to rotate the inner mandrel and the tubing string.

16. The apparatus as claimed in claim 15 wherein the mechanical advantage creating means are comprised of at least one set of gears.

17. The apparatus as claimed in claim 16 wherein the turning means are further comprised of means, operatively connected to the mechanical advantage creating means, for limiting the torque generated by the mechanical advantage creating means in order to inhibit the generation of torque sufficient to cause damage to the apparatus or the tubing string.

18. The apparatus as claimed in claim 14 wherein the turning means are manually operable.

19. The apparatus as claimed in claim 14 wherein the wellhead includes a reciprocating rod and the turning means are operatively connected to the reciprocating rod such that reciprocation of the reciprocating rod turns the pinion shaft in order to rotate the inner mandrel.

20. The apparatus as claimed in claim 14 wherein the wellhead includes a rotating rod and the turning means are operatively connected to the rotating rod such that rotation of the rotating rod turns the pinion shaft in order to rotate the inner mandrel.

21. The apparatus as claimed in claim 15 wherein the wellhead includes a rotating rod and the apparatus is further comprised of an adaptor for operatively connecting the rotating rod to the mechanical advantage creating means such that rotation of the rotating rod turns the pinion shaft in order to rotate the inner mandrel.

22. The apparatus as claimed in claim 21 wherein the adaptor is comprised of:

(a) a tubular sleeve fixedly mountable on the rotating rod such that the rod is contained within the sleeve and rotation of the rod rotates the sleeve;

(b) a first shaft having a connector end and a drive end, the drive end being releasably engaged with the sleeve such that the rotation of the sleeve rotates the first shaft;

(c) an adaptor housing for supporting the drive end of the first shaft mounted about the sleeve such that the sleeve is rotatable within the adaptor housing while the adaptor housing remains stationary; and (d) means for operatively connecting the first shaft to the rotating means so that rotation of the rotating rod rotates the inner mandrel and the tubing string.

23. The apparatus as claimed in claim 22 wherein the connecting means are comprised of a flexible second shaft having a first end operatively connected to the connector end of the first shaft such that rotation of the first shaft rotates the second shaft and a second end operatively connectable to the mechanical advantage creating means so that the torque generated by rotation of the second shaft is translated to sufficient torque to turn the pinion shaft in order to rotate the inner mandrel.

24. The apparatus as claimed in claim 23 wherein the mechanical advantage creating means are comprised of more than one set of gears in series such that the torque generated by the second shaft is stepped up in stages to a level sufficient to turn the pinion shaft in order to rotate the inner mandrel.

25. The apparatus as claimed in claim 24 wherein the mechanical advantage creating means are comprised of three worm and worm gear sets in series.

26. The apparatus as claimed in claim 23, 24 or 25 wherein the sleeve includes a crown gear which is releasably engaged with a pinion on the drive end of the first shaft such that rotation of the sleeve rotates the first shaft.

27. The apparatus as claimed in claim 26 further comprising a releasable clamping ring secured about the sleeve for fixedly mounting the sleeve on the rotating rod.

28. The apparatus as claimed in claim 26 wherein at least one support bearing is located between the sleeve and the adaptor housing such that the sleeve is rotatable within the stationary adaptor housing.

29. The apparatus as claimed in claim 26 wherein the first shaft is rotatably supported within the adaptor housing by at least one support bearing.

30. The apparatus as claimed in claim 2 further comprising means for securing the inner mandrel to the outer member such that upward longitudinal movement of the inner mandrel relative to the outer member is inhibited.

31. The apparatus as claimed in claim 2 wherein the wellhead flange defines more than one aperture forming a first bolt ring for receiving fasteners therein and the wellhead further comprises a tubular adaptor flange mountable on the upper surface of the housing such that when the apparatus is attached to the wellhead, the housing and the support flange are located between the adaptor flange and the wellhead flange, the adaptor flange defining more than one aperture forming a second bolt ring compatible with the first bolt ring, the housing, and the support flange such that fasteners can be extended through the apertures in the adaptor flange and the wellhead flange in order to secure the housing and the support flange between the adaptor flange and the wellhead flange.

32. The apparatus as claimed in claim 4 wherein the wellhead flange defines more than one aperture forming a first bolt ring for receiving fasteners therein and the wellhead further comprises a tubular adaptor flange mountable on the upper surface of the housing such that when the apparatus is attached to the wellhead, the housing and the support flange are located between the adaptor flange and the wellhead flange, the adaptor flange defining more than one aperture forming a second bolt ring compatible with the first bolt ring, the housing, and the support flange such that fasteners can be extended through the apertures in the adaptor flange and the wellhead flange in order to secure the housing and the support flange between the adaptor flange and the wellhead flange.

33. The apparatus as claimed in claim 5 wherein the wellhead flange defines more than one aperture forming a first bolt ring for receiving fasteners therein and the wellhead further comprises a tubular adaptor flange mountable on the upper surface of the housing such that when the apparatus is attached to the wellhead, the housing and the support flange are located between the adaptor flange and the wellhead flange, the adaptor flange defining more than one aperture forming a second bolt ring compatible with the first bolt ring, the housing, and the support flange such that fasteners can be extended through the apertures in the adaptor flange and the wellhead flange in order to secure the housing and the support flange between the adaptor flange and the wellhead flange.

34. The apparatus as claimed in claim 2 wherein the inner mandrel is rotatably supported within the outer member by a thrust bearing located between the inner mandrel and the outer member such that the thrust bearing is seated on the outer member and the inner mandrel is rotatably supported upon the thrust bearing.

35. The apparatus as claimed in claim 4 wherein the inner mandrel is rotatably supported within the outer member by a thrust bearing located between the inner mandrel and the outer member such that the thrust bearing is seated on the outer member and the inner mandrel is rotatably supported upon the thrust bearing.

36. The apparatus as claimed in claim 5 wherein the inner mandrel is rotatably supported within the outer member by a thrust bearing located between the inner mandrel and the outer member such that the thrust bearing is seated on the outer member and the inner mandrel is rotatably supported upon the thrust bearing.

37. The apparatus as claimed in claim 7 wherein the inner mandrel is rotatably supported within the outer member by a thrust bearing located between the inner mandrel and the outer member such that the thrust bearing is seated on the outer member and the inner mandrel is rotatably supported upon the thrust bearing.

38. The apparatus as claimed in claim 8 wherein the inner mandrel is rotatably supported within the outer member by a thrust bearing located between the inner mandrel and the outer member such that the thrust bearing is seated on the outer member and the inner mandrel is rotatably supported upon the thrust bearing.

39. The apparatus as claimed in claim 2 wherein the wellbore includes a casing string for containing the tubing string and the wellhead flange is located at the upper end of the casing string.

40. The apparatus as claimed in claim 4 wherein the wellbore includes a casing string for containing the tubing string and the wellhead flange is located at the upper end of the casing string.

41. The apparatus as claimed in claim 5 wherein the wellbore includes a casing string for containing the tubing string and the wellhead flange is located at the upper end of the casing string.

42. The apparatus as claimed in claim 7 wherein the wellbore includes a casing string for containing the tubing string and the wellhead flange is located at the upper end of the casing string.

43. The apparatus as claimed in claim 8 wherein the wellbore includes a casing string for containing the tubing string and the wellhead flange is located at the upper end of the casing string.

44. The apparatus as claimed in claim 2 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

45. The apparatus as claimed in claim 4 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

46. The apparatus as claimed in claim 5 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

47. The apparatus as claimed in claim 7 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

48. The apparatus as claimed in claim 8 wherein the inner mandrel includes a crown gear and the rotating means are comprised of a rotatable pinion contained within the housing and releasably engaged with the crown gear and means for driving the pinion such that rotation of the pinion rotates the inner mandrel within the outer member.

49. The apparatus as claimed in claim 12 wherein the crown gear is integral with the inner mandrel.

50. The apparatus as claimed in claim 15 wherein the turning means are manually operable.

51. The apparatus as claimed in claim 16 wherein the turning means are manually operable.

52. The apparatus as claimed in claim 17 wherein the turning means are manually operable.

53. The apparatus as claimed in claim 15 wherein the wellhead includes a reciprocating rod and the turning means are operatively connected to the reciprocating rod such that reciprocation of the reciprocating rod turns the pinion shaft in order to rotate the inner mandrel.

54. The apparatus as claimed in claim 16 wherein the wellhead includes a reciprocating rod and the turning means are operatively connected to the reciprocating rod such that reciprocation of the reciprocating rod turns the pinion shaft in order to rotate the inner mandrel.

55. The apparatus as claimed in claim 17 wherein the wellhead includes a reciprocating rod and the turning means are operatively connected to the reciprocating rod such that reciprocation of the reciprocating rod turns the pinion shaft in order to rotate the inner mandrel.

56. The apparatus as claimed in claim 15 wherein the wellhead includes a rotating rod and the turning means are operatively connected to the rotating rod such that rotation of the rotating rod turns the pinion shaft in order to rotate the inner mandrel.

57. The apparatus as claimed in claim 16 wherein the wellhead includes a rotating rod and the turning means are operatively connected to the rotating rod such that rotation of the rotating rod turns the pinion shaft in order to rotate the inner mandrel.

58. The apparatus as claimed in claim 17 wherein the wellhead includes a rotating rod and the turning means are operatively connected to the rotating rod such that rotation of the rotating rod turns the pinion shaft in order to rotate the inner mandrel.

59. The apparatus as claimed in claim 16 wherein the wellhead includes a rotating rod and the apparatus is further comprised of an adaptor for operatively connecting the rotating rod to the mechanical advantage creating means such that rotation of the rotating rod turns the pinion shaft in order to rotate the inner mandrel.

60. The apparatus as claimed in claim 17 wherein the wellhead includes a rotating rod and the apparatus is further comprised of an adaptor for operatively connecting the rotating rod to the mechanical advantage creating means such that rotation of the rotating rod turns the pinion shaft in order to rotate the inner mandrel.

61. In combination with an apparatus, connected to a wellhead including a rotating rod, for suspending and rotating a tubing string contained within a wellbore, the apparatus having means for rotating the tubing string suspended by the apparatus, wherein the improvement comprises an adaptor operatively connecting the rotating rod to the rotating means such that rotation of the rotating rod operates the rotating means in order to rotate the tubing string within the wellbore, wherein the adaptor comprises:

(a) a tubular sleeve fixedly mountable on the rotating rod such that the rod is contained within the sleeve and rotation of the rod rotates the sleeve;

(b) a first shaft having a connector end and a drive end, the drive end being releasably engaged with the sleeve such that rotation of the sleeve rotates the first shaft;

(c) an adaptor housing for supporting the drive end of the first shaft mounted about the sleeve such that the sleeve is rotatable within the adaptor housing while the adaptor housing remains stationary; and (d) means for operatively connecting the first shaft to the rotating means so that rotation of the rotating rod rotates the tubing string.

62. The adaptor as claimed in claim 61 wherein the rotating means are comprised of means for creating a mechanical advantage to facilitate the generation of sufficient torque by the adaptor to rotate the rotating means in order to operate the apparatus.

63. The adaptor as claimed in claim 62 wherein the connecting means are comprised of a flexible second shaft having a first end operatively connected to the connector end of the first shaft such that rotation of the first shaft rotates the second shaft and a second end operatively connectable to the mechanical advantage creating means so that the torque generated by rotation of the second shaft is translated to sufficient torque to rotate the rotating means.

64. The adaptor as claimed in claim 63 wherein the mechanical advantage creating means are comprised of at least one set of gears.

65. The adaptor as claimed in claim 64 wherein the mechanical advantage creating means are operatively connected to means for limiting the torque generated by the mechanical advantage creating means in order to inhibit the generation of torque sufficient to cause damage to the adaptor or the apparatus.

66. The adaptor as claimed in claim 64 wherein the mechanical advantage creating means are comprised of more than one set of gears in series such that the torque generated by the second shaft is stepped up in stages to a level sufficient to rotate the rotating means of the apparatus.

67. The adaptor as claimed in claim 60 wherein the mechanical advantage creating means are comprised of three worm and worm gear sets in series.

68. The adaptor as claimed in claim 65 wherein the mechanical advantage creating means are comprised of more than one set of gears in series such that the torque generated by the second shaft is stepped up in stages to a level sufficient to rotate the rotating means of the apparatus.

69. An adaptor, for connection to a wellhead having a rotating rod, for use with an apparatus having rotating means for operating the apparatus, the adaptor comprising:

(a) a tubular sleeve fixedly mountable on the rotating rod such that the rod is contained within the sleeve and rotation of the rod rotates the sleeve;

(b) a first shaft having a connector end and a drive end, the drive end being releasably engaged with the sleeve such that rotation of the sleeve rotates the first shaft;

(c) an adaptor housing for supporting the drive end of the first shaft mounted about the sleeve such that the sleeve is rotatable within the adaptor housing while the adaptor housing remains stationary; and (d) means for connecting the first shaft to the rotating means in order to operate the apparatus.

70. The adaptor as claimed in claim 61 or 69 wherein the connecting means are comprised of a flexible second shaft having a first end operatively connected to the connector end of the first shaft such that rotation of the first shaft rotates the second shaft and a second end operatively connectable to the rotating means such that rotation of the second shaft operates the apparatus.

71. The adaptor as claimed in claim 61, 69, 63, 64, 65 or 67 wherein the sleeve includes a crown gear which is releasably engaged with a pinion on the drive end of the first shaft such that rotation of the sleeve rotates the first shaft.

72. The adaptor as claimed in claim 71 further comprising a releasable clamping ring secured about the sleeve for fixedly mounting the sleeve on the rotating rod.

73. The adaptor as claimed in claim 71 wherein at least one support bearing is located between the sleeve and the adaptor housing such that the sleeve is rotatable within the stationary adaptor housing.

74. The adaptor as claimed in claim 71 wherein the first shaft is rotatably supported within the adaptor housing by at least one support bearing.

75. The adaptor as claimed in claim 69 wherein the rotating means are comprised of means for creating a mechanical advantage to facilitate the generation of sufficient torque by the adaptor to rotate the rotating means in order to operate the apparatus.

* * * * *